US005617830A

United States Patent [19]

Ishiwata et al.

[11] Patent Number: 5,617,830

[45] Date of Patent: Apr. 8, 1997

[54] PRESTROKE CONTROLLER FOR ENGINE FUEL INJECTION PUMP

[75] Inventors: Hiroshi Ishiwata; Tohru Yokota; Mitsuaki Kobayashi; Tsutomu Katori; Teruo Ohsawa, all of Higashi-Matsuyama, Japan

[73] Assignee: Zexel Corporation, Japan

[21] Appl. No.: 507,829

[22] Filed: Jul. 27, 1995

[30] Foreign Application Priority Data

| | | | |
|---|---|---|---|
| Jul. 27, 1994 | [JP] | Japan | 6-193782 |
| Jul. 27, 1994 | [JP] | Japan | 6-193839 |
| Apr. 12, 1995 | [JP] | Japan | 7-110273 |

[51] Int. Cl.[6] ..... F02M 37/04

[52] U.S. Cl. ..... 123/500; 123/300; 123/373

[58] Field of Search ..... 123/249, 300, 123/500, 501, 373, 359

[56] References Cited

U.S. PATENT DOCUMENTS

| | | | |
|---|---|---|---|
| 3,698,373 | 10/1972 | Nagasawa | 123/300 |
| 3,827,419 | 8/1974 | Isomura | 123/300 |
| 4,294,210 | 10/1981 | Bassoli | 123/300 |
| 4,619,233 | 10/1986 | Yamaguchi | 123/500 |
| 4,630,586 | 12/1986 | Guntert | 123/500 |
| 4,754,737 | 7/1988 | Ishida | 123/500 |
| 4,825,842 | 5/1989 | Steiger | 123/300 |
| 5,382,792 | 1/1995 | Hurst et al. . | |

FOREIGN PATENT DOCUMENTS

| | | | |
|---|---|---|---|
| 0079662 | 5/1983 | Japan | 123/300 |
| 3-233144 | 10/1991 | Japan . | |
| 573755 | 12/1993 | Japan . | |
| 2180370 | 3/1987 | United Kingdom . | |
| 2189846 | 11/1987 | United Kingdom . | |
| 9205622 | 4/1992 | WIPO . | |

OTHER PUBLICATIONS

Patent Abstract of Japan, vol. 16, No. 10 (M–1199), 13 Jan. 1992 & JP–A–03 233144 (Zexel Corp.) 17 Oct. 1991.

*Primary Examiner*—Carl S. Miller

*Attorney, Agent, or Firm*—Ostrolenk, Faber, Gerb & Soffen, LLP

[57] ABSTRACT

A prestroke controller 31 for an engine fuel injection pump 30 utilizes a magnetic coupling 26 and, by taking advantage of the fact that the secondary side (driven side internal magnet) of the magnetic coupling can be controlled to a desired position without being driven by force from a flyweight 11 on the primary side (driving side external magnet), not only secures speed timer characteristics but also provides a greater degree of freedom in determining the injection timing advance characteristic. The prestroke controller 31 includes the magnetic coupling 26 as a member of a displacement transfer section provided between the flyweight 11 and the timing control rod 6 and also includes an add-on device 36 for injection timing advance adjustment which can be engaged with or disengaged from the timing control rod 6 and is capable of controlling the prestroke independently of the magnetic coupling 26.

20 Claims, 26 Drawing Sheets

Neutral state Displaced state

PRESTROKE CONTROLLER FOR ENGINE FUEL INJECTION PUMP

BACKGROUND OF THE INVENTION

1. Field of the Invention

This invention relates to a prestroke controller for an engine fuel injection pump, more particularly to a prestroke controller for an engine fuel injection pump which during adjustment of an injection timing advance characteristic by use of one or more governor flyweights enables prestroke control independently of the flyweights or enables prestroke control altogether independently of flyweight lift and in addition transfers governor flyweight lift utilizing a magnetic coupling.

2. Prior Art

In some prior art fuel injection pumps the fuel injection timing advance characteristic is adjusted by controlling the prestroke. In the fuel injection pumps disclosed in Japanese Patent Disclosure No. Hei 3-233144 and Japanese Utility Model Application No. Hei 5-73755, for example, the prestroke is adjusted and the fuel injection timing is controlled by utilizing the movement (lift) of the governor flyweight(s) as a source of driving power for operating the timing control rod.

In a fuel injection pump equipped with a plunger which sucks in and pressurizes fuel by reciprocating axially, the prestroke refers to the stroke of the plunger between its bottom dead point and the point at which pressurized fuel delivery starts. The fuel injection characteristic appropriate for the engine operating condition is obtained by shortening the prestroke to cause the fuel injection to start earlier (injection timing advance) or lengthening it to cause the fuel injection to start later (injection timing retard).

The prestroke controller for a fuel injection pump taught by the aforesaid Japanese Patent Disclosure No. Hei 3-233144 will be briefly explained with reference to FIG. 39.

FIG. 39 is a perspective view of the prestroke controller for an engine fuel injection pump, designated by reference numeral 1, and a conventional mechanical governor, designated reference numeral 2. On the side of the main pump unit 3 are shown a plunger 4, a control sleeve 5, and a timing control rod 6 whose engagement pin 8 is engaged with an engagement groove 7 of the control sleeve 5.

On the side of the mechanical governor 2, a cam shaft 9 for reciprocating the plunger 4 in the main pump unit 3 is fitted with a guide sleeve 10 and a flyweight 11 is connected with the guide sleeve 10.

The prestroke controller for an engine fuel injection pump 1, which comprises the flyweight 11 as a component utilized in common with the mechanical governor 2, further has a tension lever 13 serving as a prestroke control lever which pivots around a stationary pivot shaft 12 in accordance with the movement of the flyweight 11, a timing cam 14, a counterweight 15 connected with the timing control rod 6, and a cam surface abutment piece 16 formed integrally with the counterweight 15.

The timing cam 14 is connected with one side of the free end of the tension lever 13 through a connection lever 17 and is rotatable around a stationary pivot shaft 18. A cam surface abutment projection 16A of the cam surface abutment piece 16 is pressed onto the cam surface 14A of the timing cam 14 at a prescribed pressure by the force of a counterweight spring 19 (return spring).

The other side of the free end of the tension lever 13 is connected with a torque cam 21 which is part of a governor mechanism 20 of the mechanical governor 2. Although this is for enabling the governor mechanism 20 to automatically control the fuel injection quantity in response to variation in engine load, the governor mechanism 20 will not be described in detail here.

An injection quantity control rack 22 is provided in association with the torque cam 21. The injection quantity control rack 22 controls the fuel injection quantity by rotating the plunger 4 about its own axis.

In the prestroke controller for an engine fuel injection pump 1 of the aforesaid configuration, an increase in engine speed (pump speed) increases the centrifugal force of the flyweight 11 causing it to shift and slide the guide sleeve 10 along the cam shaft 9 to the right in FIG. 39. As a result, the tension lever 13 rotates about the stationary pivot shaft 12, whereby the mechanical governor 2 performs the prescribed governor function and the timing cam 14 is rotated about the stationary pivot shaft 18 by the connection lever 17.

Since this rotation of the timing cam 14 changes the positional relationship between the timing control cam surface 14A and the cam surface abutment projection 16A of the cam surface abutment piece 16, the cam surface abutment piece 16 and the counterweight 15 are rotated about the axis of the timing control rod 6.

The resulting rotation of the timing control rod 6 by a corresponding angle moves the control sleeve 5 vertically and changes the positional relationship between the control sleeve 5 and the plunger 4, thus changing the fuel injection timing or the prestroke.

As explained in the foregoing, the prestroke controller 1 controls the start of pressurized fuel delivery by the main pump unit 3 by changing the position of the control sleeve 5 relative to the axial direction of the plunger 4. For this, the position of the control sleeve 5 is changed by operating the timing control rod 6.

In addition, the flyweight 11 and tension lever 13, which are members of the governor mechanism 20, are employed for operating the timing control rod 6 to change the position of the control sleeve 5.

Since the flyweight 11 utilized by the prior art prestroke controller 1 moves with increasing engine speed, the prestroke controller 1 is incapable of providing the injection timing advance characteristic required of a speed timer for varying the injection timing as a function of engine speed. The prior art prestroke controller 1 thus has the drawback of being all but impossible to apply for controlling prestroke in accordance with an injection timing advance characteristic during operation in a cold external environment or in response to changes in the amount of accelerator depression or the engine load state.

FIG. 40 is an enlarged sectional view of an essential portion of the coupling (displacement transfer section 23) between a mechanical governor 2 and a main pump unit 3 of the fuel injection pump of the aforesaid Japanese Utility Model Application No. Hei 5-73755. A displacement transfer rod 24 connected with a flyweight 11 (not shown) through a tension lever 13 (not shown) and the like transfers displacement to a timing control rod 6 through a partition 25 by means of a magnetic coupling 26.

The magnetic coupling 26 includes a driving side external magnet 27 and a driven side internal magnet 28. By rotating the displacement transfer rod 24 a rotational force can be transferred to the timing control rod 6 through the magnetic coupling 26.

The various merits obtained by utilizing the magnetic coupling 26 of the aforesaid configuration for the transfer of torque include: that the structure can be made simpler and more reliable than in the case of the conventional mechanical governor 2 requiring a fuel seal, that low temperature operation is made possible, that the injection quantity control function of the mechanical governor 2 is not lost even if the control sleeve 5 should stick for some reason, that forces produced by external disturbances can be canceled by the counterweight 15 (FIG. 39), and that the absence of contact with the controlled member (the timing control rod 6) ensures that the injection quantity control function of the mechanical governor 2 is not affected during idling.

Moreover, as can be seen in FIG. 41 showing the magnetic coupling 26 as viewed from the side of the mechanical governor 2 toward the main pump unit 3, a self-aligning torque T arises when the driving side external magnet 27 and the driven side internal magnet 28 are offset from their neutral state by an angle θ. The characteristics of the self-aligning torque T are shown in FIG. 42.

When the magnetic coupling 26 is utilized for torque transfer, it is able to transfer the peak value of the self-aligning torque.

The magnetic force of a magnetic such as the driving side external magnet 27 or the driven side internal magnet 28 varies with temperature. For example, a ferrite magnet demagnetizes at low temperatures while a neodymium magnet demagnetizes at a high temperature. Because of this, the displacement of the driven side internal magnet 28 on the output side produced by a given displacement of the driving side external magnet 38 on the input side decreases by an angle proportional to the load torque (approximately equal to the force which the counterweight spring 19 (FIG. 39) applies to the timing control rod 6) at each of angles $\theta_1$, $\theta_2$, $\theta_3$.

Thus when torque is transferred by angular displacement in this way, a deviation proportional to the self-aligning torque T occurs in the angle θ.

This gives rise to the problem that the minimum prestroke position (maximum injection timing advance position) varies with the ambient temperature.

In other words, as shown in FIG. 43, owing to the temperature dependency of the driving side external magnet 27 and the driven side internal magnet 28, the amount of timing advance (prestroke) for a given pump speed Np, specifically the minimum prestroke, is not constant, creating the problem that the amount of timing advance is destabilized by the ambient temperature.

When torque is transferred from the side of the mechanical governor 2 to the side of the main pump unit 3 using the magnetic coupling 26, it is conceivable to control the prestroke characteristic by inserting a component such as a cylindrical cam with a prescribed cam surface. It is, however, necessary to provide a mechanism that exhibits a sufficient torque transfer capability and that does not adversely affect the operation of the injection quantity control rack.

Moreover, when the prestroke is controlled in accordance with movement of the flyweight 11, it is necessary to be able to adjust the prestroke control start time.

As was explained in the foregoing, the magnetic coupling 26 serves as a safety mechanism ensuring operation of the tension lever 13 side, namely the function of the governor mechanism 20 as a control mechanism for the injection quantity control rack 22, even if sticking should occur on the side of the timing control rod 6 for some reason. If the magnetic coupling 26 should stick for some reason, however, the tension lever 13 will be immobilized, making it impossible for the mechanical governor 2 (the governor mechanism 20) to fulfill its control function.

More specifically, since disablement of the tension lever 13 makes control of the fuel injection quantity by the mechanical governor 2 impossible, overrun or some other such major problem may arise. It is therefore important to provide some kind of safety mechanism for the magnetic coupling 26 itself.

In addition, it is sometimes necessary to be able to control the prestroke altogether independently of the movement (lift) of the flyweight 11.

An object of the first aspect of the invention is to overcome the aforesaid problems of the prior art technology by providing a prestroke controller for an engine fuel injection pump which utilizes a magnetic coupling and which, by taking advantage of the fact that the secondary side (driven side internal magnet) of the magnetic coupling can be controlled to a desired position without being driven by force from a flyweight on the primary side (driving side external magnet), not only secures speed timer characteristics but also, by establishing a greater degree of freedom in determining the injection timing advance characteristic, enables injection timing advance in response to temperature or load.

Another object of the first aspect of the invention is to provide a prestroke controller for an engine fuel injection pump enabling low-temperature injection timing advance and low-load injection timing advance independently of engine speed (flyweight lift).

An object of the second aspect of the invention is to provide a prestroke controller for an engine fuel injection pump which capitalizes on the advantages of utilizing a magnetic coupling and further prevents change in minimum prestroke position owing to change in ambient air temperature.

An object of the third aspect of the invention is to provide a fuel prestroke controller for an engine fuel injection pump which, in the case where torque is transferred from the side of a mechanical governor to the side of a main pump unit using one or more flyweights and a magnetic coupling, achieves efficient torque transfer capability by efficiently driving the magnetic coupling for controlling the prestroke characteristic.

An object of the fourth aspect of the invention is to provide a prestroke controller for an engine fuel injection pump which, in the case where one or more flyweights and a magnetic coupling are used and prestroke is controlled in accordance with flyweight lift, also enables adjustment of the prestroke control start time thereby enabling both adjustment of the prestroke control characteristic and matching adjustment.

An object of the fifth aspect of the invention is to provide a prestroke controller for an engine fuel injection pump which, in the case where the lift of one or more flyweights of a mechanical governor is transferred as displacement by a magnetic coupling, is capable of ensuring operation of the mechanical governor even if the magnetic coupling should stick.

Another object of the fifth aspect of the invention is to provide a prestroke controller for an engine fuel injection pump provided with a safety mechanism for enabling operation of a tension lever of the governor mechanism even if the magnetic coupling should stick.

An object of the sixth aspect of the invention is to provide a prestroke controller for an engine fuel injection pump which enables prestroke control in response to the degree of depression of an accelerator pedal altogether independently of flyweight lift.

SUMMARY OF THE INVENTION

The present invention takes advantage of the fact that it is possible to control the timing control rod independently of flyweight movement (lift) by applying to the timing control rod a force that is larger than the force being transferred by the magnetic coupling and, further, in the first aspect of the invention, provides an add-on device for adjusting injection timing advance in association with the timing control rod on the side of the magnetic coupling opposite from the mechanical governor. More specifically, the first aspect of the invention provides a prestroke controller for all engine fuel injection pump comprising a plunger which sucks in and pressurizes fuel by reciprocating axially in response to rotation of a cam shaft connected with an engine, a control sleeve slidably fitted on the plunger, a timing control rod connected with the control sleeve and which operates to adjust the prestroke by changing the position of the control sleeve relative to the axial direction of the plunger, a flyweight which moves in response to rotation of the cam shaft, a magnetic coupling provided at a displacement transfer section between the flyweight and the timing control rod, and an add-on device for injection advance adjustment engageable with the timing control rod for controlling the prestroke independently of the magnetic coupling.

The add-on device for injection advance adjustment can be constituted as a temperature injection timing advance member.

The add-on device for injection advance adjustment can also be constituted as a load injection timing advance member.

The second aspect of the invention takes advantage of the fact that it is possible to provide a limiting stop for determining a minimum prestroke (minimum timing advance). More specifically, the second aspect of the invention provides a prestroke controller for an engine fuel injection pump comprising a plunger which sucks in and pressurizes fuel by reciprocating axially in response to rotation of a cam shaft connected with an engine, a control sleeve slidably fitted on the plunger, a timing control rod connected with the control sleeve and which operates to adjust the prestroke by changing the position of the control sleeve relative to the axial direction of the plunger, a flyweight which moves in response to rotation of the cam shaft, a magnetic coupling provided at a displacement transfer section between the flyweight and the timing control rod, a counterweight attached to the timing control rod, and a limiting stop provided opposite the counterweight for determining a minimum prestroke independently of the magnetic coupling.

The third aspect of the invention takes advantage of the fact that it is possible to provide a magnetic coupling as the means for transferring torque from the mechanical governor side to the main pump unit side, make the magnetic coupling drivable and provide a timing cam having a prescribed cam surface. More specifically, the third aspect of the invention provides a prestroke controller for an engine fuel injection pump comprising a plunger which sucks in and pressurizes fuel by reciprocating axially in response to rotation of a cam shaft connected with an engine, a control sleeve slidably fitted on the plunger, a timing control rod connected with the control sleeve and which operates to adjust the prestroke by changing the position of the control sleeve relative to the axial direction of the plunger, a flyweight which moves in response to rotation of the cam shaft, a magnetic coupling provided at a displacement transfer section between the flyweight and the timing control rod, a timing cam drivable in response to movement of the flyweight, and a flyweight side torque transfer mechanism connecting the timing cam and the magnetic coupling.

The flyweight side torque transfer mechanism can comprise a connecting pin provided on the outer surface of the magnetic coupling and a timing lever connected with the connecting pin and slidably abutting on a cam surface of the timing cam.

The fourth aspect of the invention is particularly directed to enabling adjustment of the prestroke control start time. More specifically, the fourth aspect of the invention provides a prestroke controller for an engine fuel injection pump comprising a plunger which sucks in and pressurizes fuel by reciprocating axially in response to rotation of a cam shaft connected with an engine, a control sleeve slidably fitted on the plunger, a timing control rod connected with the control sleeve and which operates to adjust the prestroke by changing the position of the control sleeve relative to the axial direction of the plunger, a flyweight which moves in response to rotation of the cam shaft, a magnetic coupling provided at a displacement transfer section between the flyweight and the timing control rod, and a prestroke control start time control mechanism provided between the magnetic coupling and the flyweight for adjusting the prestroke control start time in accordance with movement of the flyweight.

The prestroke control start time control mechanism can comprise a phase adjustment rod connected with the flyweight to be adjustable in amount of projection, a first lever connected with the phase adjustment rod, and a second lever drivable via the first lever at prescribed timing and by an amount proportional to flyweight lift.

The second lever can be formed with an initial position limiting projection and a final position limiting projection.

The fifth aspect of the invention is particularly aimed at establishing a safety mechanism for ensuring governor operation between a prestroke control mechanism including a mechanical governor and an injection quantity control rack mechanism including a tension lever and the like. Specifically, it provides a prestroke controller for an engine fuel injection pump comprising a plunger which sucks in and pressurizes fuel by reciprocating axially in response to rotation of a cam shaft connected with an engine, a control sleeve slidably fitted on the plunger, a timing control rod connected with the control sleeve and which operates to adjust the prestroke by changing the position of the control sleeve relative to the axial direction of the plunger, a governor mechanism having a flyweight which moves in response to rotation of the cam shaft, a magnetic coupling provided at a displacement transfer section between the flyweight and the timing control rod, a prestroke control mechanism including the magnetic coupling, and a safety mechanism provided between the prestroke control mechanism and the governor mechanism for ensuring operation of the governor mechanism based on the movement of the flyweight even when a problem arises in the magnetic coupling.

The safety mechanism can comprise a tension lever linked with the flyweight in the governor mechanism and a lever (first lever) provided between the tension lever and a phase adjustment rod movable relative to the tension lever.

The safety mechanism can be constituted by providing an intermediate link connected with a tension lever linked with the flyweight in the governor mechanism.

The safety mechanism can be provided either between an intermediate link connected with the tension lever linked with a flyweight of the governor mechanism and the tension lever or between the intermediate link and a sensor lever abutting on the magnetic coupling.

The sixth aspect of the invention is particularly directed to advancing and retarding injection timing in response to the degree of depression of an accelerator pedal. More specifically, the sixth aspect of the invention provides a prestroke controller for an engine fuel injection pump comprising a plunger which sucks in and pressurizes fuel by reciprocating axially in response to rotation of a cam shaft connected with an engine, a control sleeve slidably fitted on the plunger, a timing control rod connected with the control sleeve and which operates to adjust the prestroke by changing the position of the control sleeve relative to the axial direction of the plunger, a speed lever connected to an accelerator wire of the engine, a magnetic coupling provided at a displacement transfer section between the speed lever and the timing control rod, an inclined lever drivable by the speed lever, and an accelerator wire side torque transfer mechanism connecting the inclined lever and the magnetic coupling.

The accelerator wire side torque transfer mechanism can comprise an abutment pin provided on the outer surface of the magnetic coupling to be drivable by the inclined lever.

In the prestroke controller for fuel injection pump in accordance with the first aspect of the invention, since the magnetic coupling enables the timing control rod to be controlled from one side of a mechanical governor in response to the lift of a flyweight and the add-on device for injection advance adjustment enables the rotation of the timing control rod to be controlled on the side of the main pump unit, the control sleeve can be controlled by rotating the timing control rod in the appropriate direction independently of the displacement transferred via the magnetic coupling in response to the lift of the flyweight. This is particularly advantageous during low-temperature or low-load operation because it allows the prestroke to be adjusted to achieve the required fuel injection timing irrespective of the engine speed.

Since the second aspect of the invention provides the limiting stop for determining the minimum prestroke on the output side of the magnetic coupling, i.e. on the timing control rod side to which the displacement is transferred, variations in the torque produced by the magnets as a result of changes in the ambient temperature are prevented from varying the minimum prestroke position. The minimum prestroke can therefore be secured with high consistency.

The invention thus makes it possible for a low-cost mechanical system to achieve an injection timing advance characteristic which is as good as that obtainable with more expensive electronic prestroke control.

Since the third aspect of the invention provides a magnetic coupling at a displacement transfer section between the mechanical governor side and the main pump unit side, a timing cam that is capable of driving the magnetic coupling and has a prescribed cam surface for controlling the prestroke characteristic, and a flyweight side torque transfer mechanism enabling connection of the timing cam and the magnetic coupling, the magnetic coupling can be smoothly operated for reliable torque transfer without imparting a reaction force to the magnetic coupling or the timing control rod side, i.e. without adversely affecting the governor function.

Since the fourth aspect of the invention enables the amount of projection of, for example, a phase adjustment rod to be adjusted in accordance with the flyweight lift, it becomes possible to adjust the prestroke control start time to thereby achieve both adjustment of the prestroke control characteristic and matching adjustment.

Since the fifth aspect of the invention provides a safety mechanism between a prestroke control mechanism including a magnetic coupling and a governor mechanism (injection quantity control rack control mechanism), the safety mechanism section ensures that the governor mechanism is able to fulfill its function even if it is not able to operate as a prestroke control mechanism because sticking occurs for some reason in the magnetic coupling section. As a result, a problem arising in the magnetic coupling can be prevented from interfering with the function of the mechanical governor.

The function of the governor to automatically control the fuel injection quantity according to the engine load can therefore be constantly maintained to preclude unexpected trouble.

In accordance with the sixth aspect of the invention, the magnetic coupling is driven via a speed lever according to the degree of depression of an accelerator pedal and the shape of the inclined lever can be designed for enabling the fuel injection timing to be advanced or retarded in accordance with a prescribed prestroke control characteristic altogether independently of flyweight lift.

The above and other features of the invention will become apparent from the following description made with reference to the drawings.

DETAILED DESCRIPTION OF THE PREFERRED EMBODIMENTS

The prestroke controller for a fuel injection pump according to the first aspect of the invention will be explained first with reference to FIGS. 1 and 2, in which portions similar to those in FIGS. 39 to 43 are assigned the same reference symbols as those in FIGS. 39 to 43 and will not be explained further here.

Figure 1:
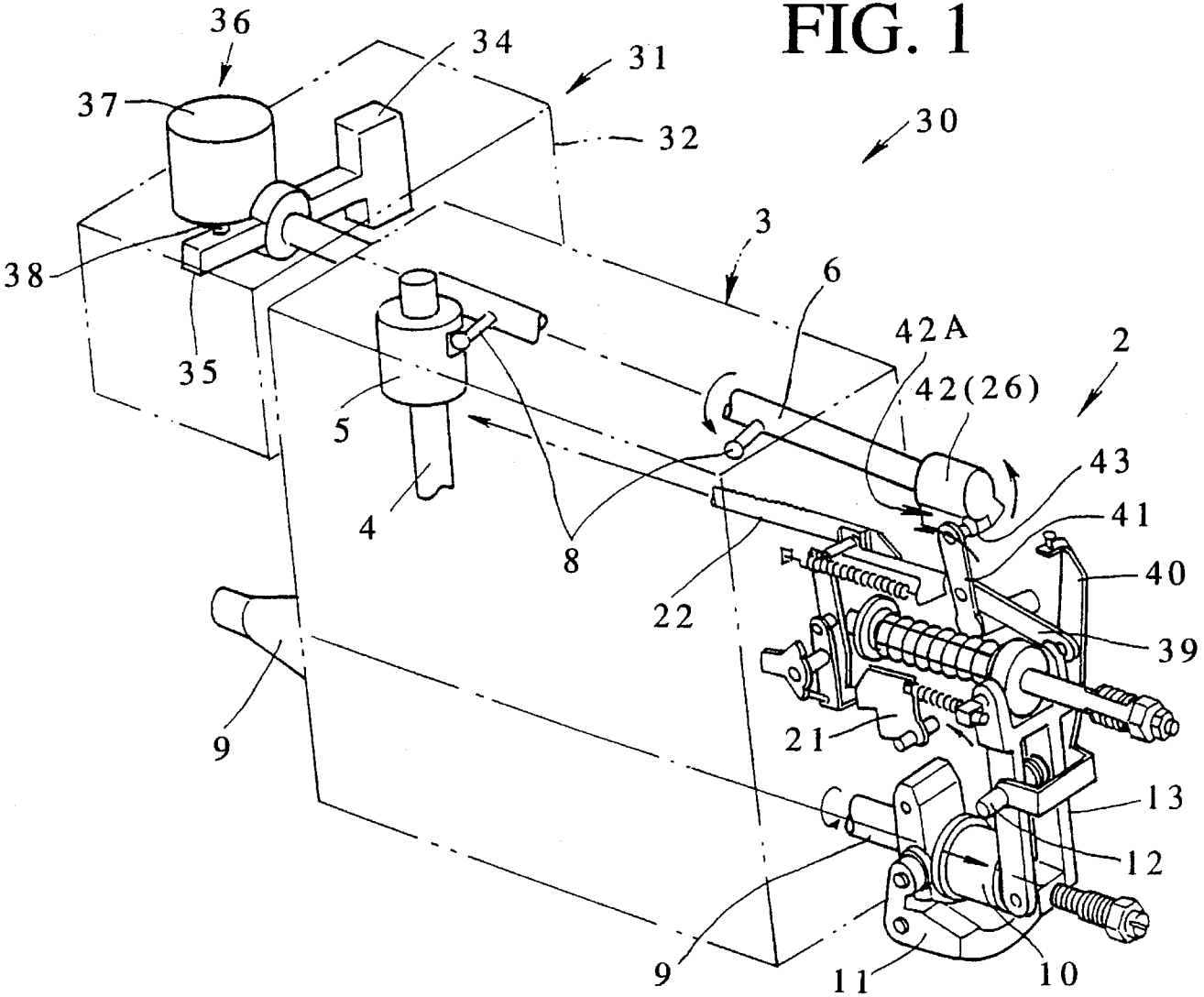
FIG. 1 is a schematic perspective view of a fuel injection pump 30 equipped with a prestroke controller 31 which is a basic embodiment (first embodiment) of the invention (first aspect).

FIG. 1 is a schematic perspective view of a fuel injection pump 30. The fuel injection pump 30 comprises an in-line main pump unit 3, a prestroke controller 31 which is a basic embodiment (first embodiment) of the invention (first aspect), and a mechanical governor 2.

Figure 2:
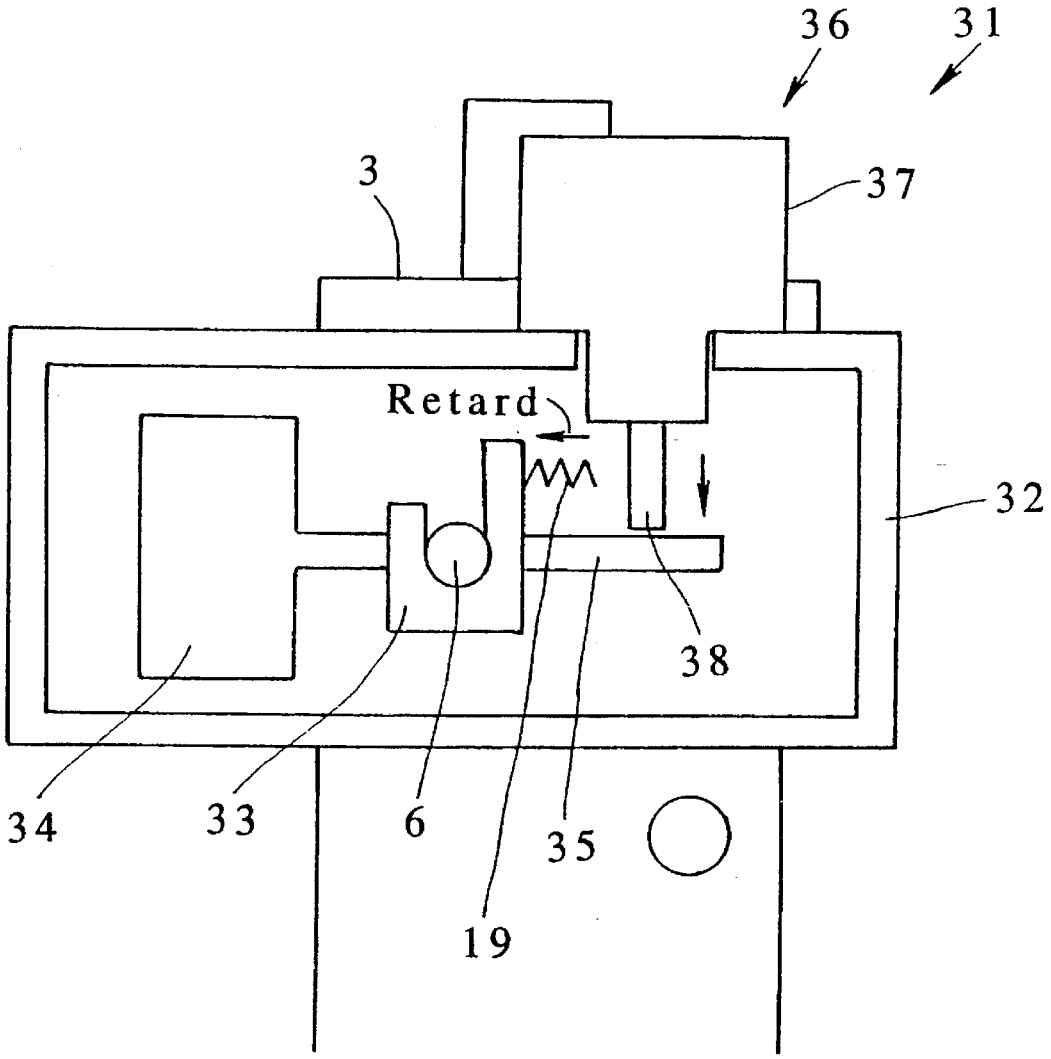
FIG. 2 is a sectional side view of the prestroke controller 31 as seen from the side of a counterweight case 32 opposite from that of the mechanical governor 2.

FIG. 2 is a sectional side view of the prestroke controller 31 as seen from the side of a counterweight case 32 opposite from that of the mechanical governor 2. The prestroke controller 31 comprises a U-shaped lever 33, a counterweight 34, an abutment lever 35 and an injection advance adjustment add-on device 36 positioned opposite the abutment lever 35.

The injection advance adjustment add-on device 36 has a device housing 37 and a control shaft 38. The control shaft 38 projects/retracts or moves with respect to the device housing 37 in response to changes in an engine operating condition such as the engine load or the degree of depression of the accelerator pedal or changes in the ambient temperature. Since the position at which the control shaft 38 abuts on the abutment lever 35 therefore changes accordingly, it is able to control (adjust) the prestroke by appropriately restricting the rotation of the timing control rod 6.

The counterweight 34 and the timing control rod 6 are constantly urged in the direction of injection timing retard by a compression return spring 19 acting thereon through the U-shaped lever 33.

On the mechanical governor 2 side of the prestroke controller 31, the prestroke can be controlled in accordance with the engine speed (pump speed) by co-utilizing the flyweight 11 of the mechanical governor 2.

More specifically, a tension lever 13 (similar to that shown in FIG. 39) has an intermediate link 39 and a guide lever 40 attached thereto, and a control lever (sensor lever) 41 is attached to the intermediate link 39.

A cylindrical cam 42 is fitted on the end portion of the timing control rod 6 opposite the mechanical governor 2 and an abutment pin 43 of the control lever (sensor lever) 41 is abutted on the cam surface 42A of the cylindrical cam 42.

The magnetic coupling 26 (FIG. 40) is built into the cylindrical cam 42 and the rotation of the cylindrical cam 42 is transferred to the timing control rod 6 through the magnetic coupling 26. The control sleeve 5 can therefore for be moved vertically with respect to the plunger 4 to adjust the prestroke in the manner explained earlier.

The profile of the cam surface 42A is determined in light of the desired prestroke control characteristic. In the illustrated example it consists of a combination of a flat portion extending linearly from the side of the timing control rod 6 and an ensuing curved portion.

In addition, an injection quantity control rack 22 is provided in association with a torque cam 21. The injection quantity control rack 22 controls the fuel injection quantity by rotating the plunger 4 about its axis.

Figure 39:
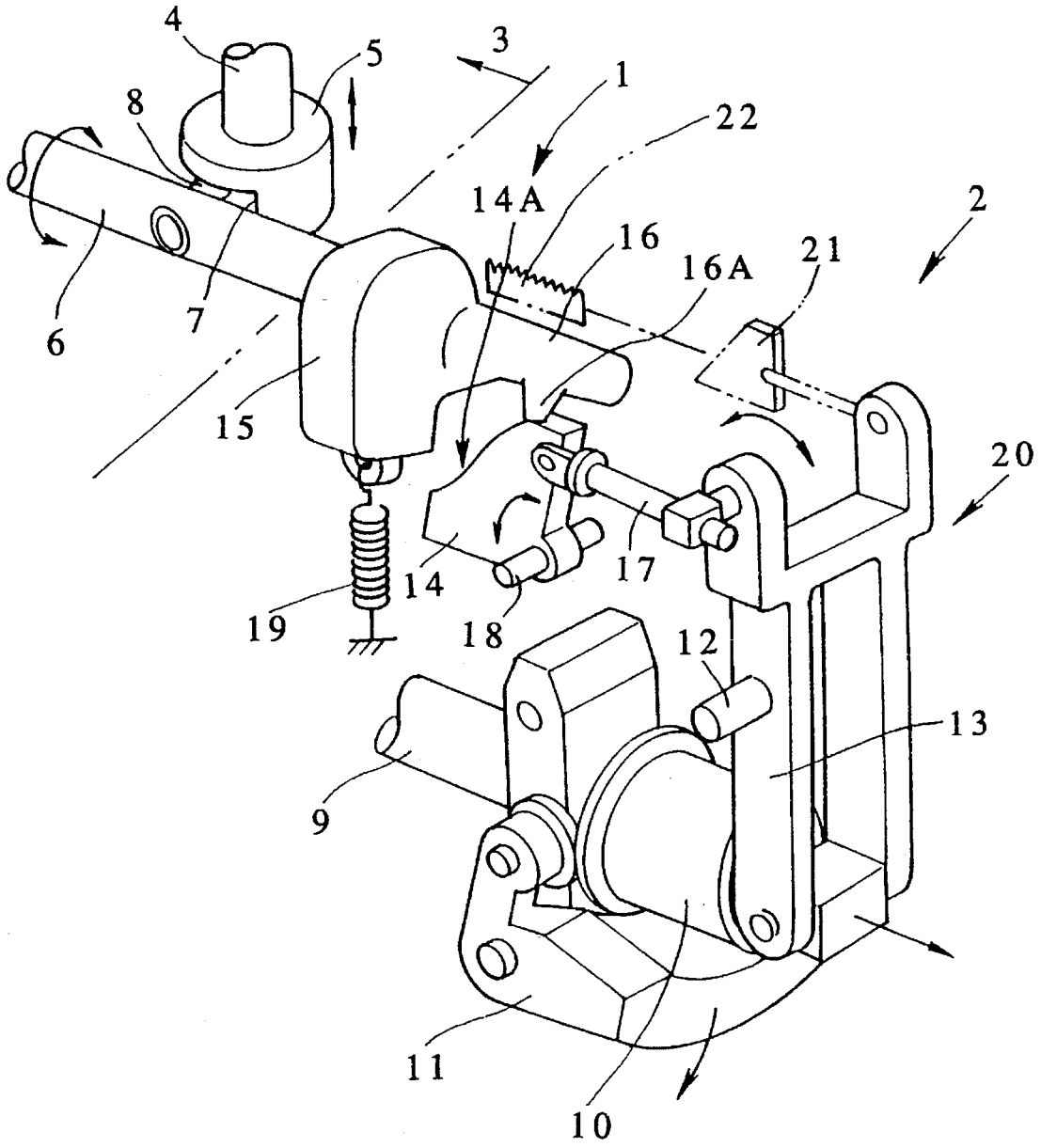
FIG.39 PRIOR ART
FIG. 39 is a schematic perspective view of a prior art prestroke controller 1 for a fuel injection pump and a prior art mechanical governor 2.
Figure 40:
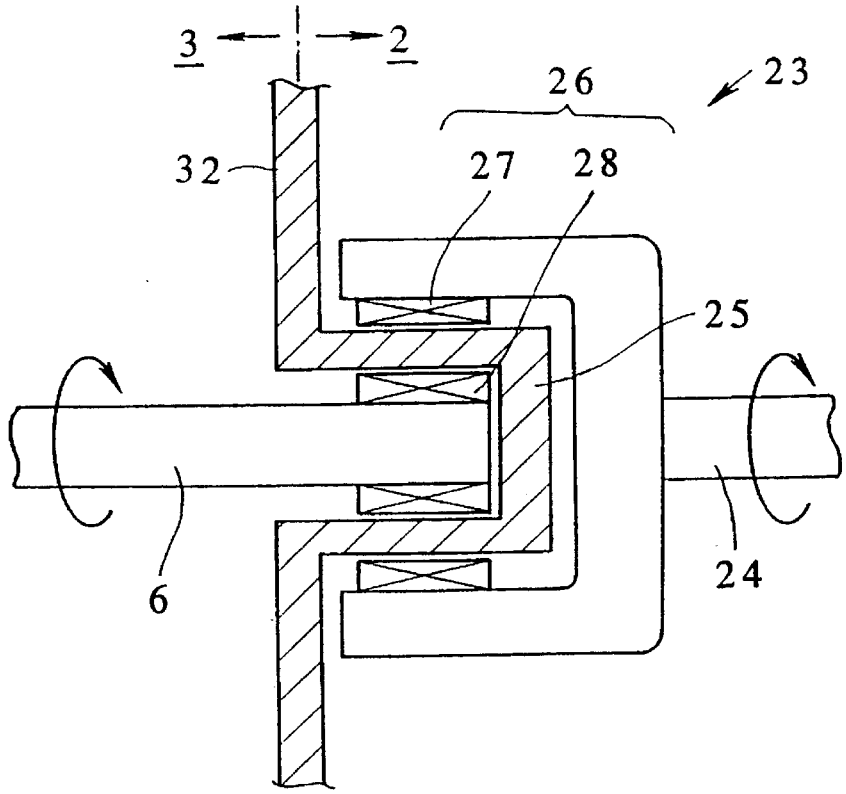
FIG. 40 is an enlarged view of an essential portion, showing the magnetic coupling 26 of a connection section (displacement transfer section 23) between the mechanical governor 2 and the main pump unit 3.
Figure 41:
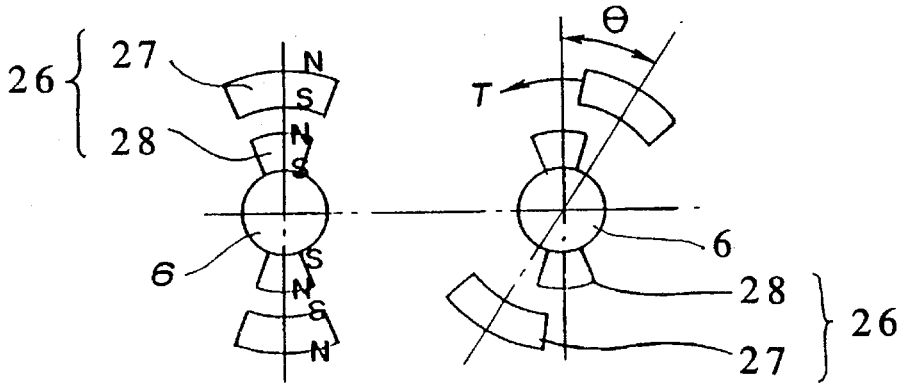
FIG. 41 is a schematic sectional view of an essential portion of the magnetic coupling 26 viewed from the side of the mechanical governor 2 toward the main pump unit 3 and showing a driving side external magnet 27 and a driven side internal magnet 28 in their neutral state and in their state as displaced from each other by an angle θ.
Figure 42:
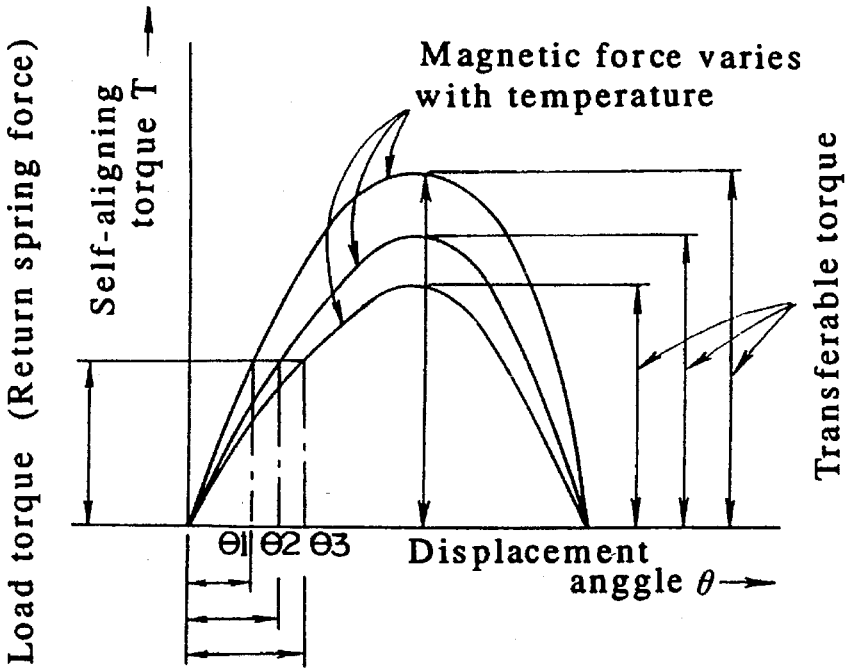
FIG. 42 is a graph showing the relationship between the displacement angle θ and a self-aligning torque T.

The prestroke controller 31 configured in the foregoing manner operates similarly to the fuel injection pump prestroke controller 1 of FIG. 39 in the point that the movement of the flyweight 11 with increasing engine speed is used to rotate the tension lever 13 and, in turn, to rotate the intermediate link 39 and the control lever 41 in the direction of the arrow.

As a result, the abutment pin 43 pushes against the cam surface 42A of the cylindrical cam 42 to rotate the cylindrical cam 42 counterclockwise in FIG. 1 and the resulting rotation of the timing control rod 6 is transferred to the engagement pin 8 which lowers the control sleeve 5, thereby shortening the prestroke and advancing the fuel injection timing.

The injection timing advance characteristic thus varies with the speed of the main pump unit 3 and is based on a so-called speed timer function. However, since the cylindrical cam 42 does not adopt the mechanically connected direct-acting system of the prior art prestroke controller 1 but instead employs the magnetic coupling 26, the driven side internal magnet 28 can rotate or stop independently of the rotation of the driving side external magnet 27 of the cylindrical cam 42.

More specifically, the control sleeve 5 can be lowered and the fuel injection timing advanced even before the flyweight 11 has moved sufficiently to rotate the cylindrical cam 42 because the timing control rod 6 can be independently rotated in the counterclockwise direction in FIG. 1 by extending the control shaft 38 of the injection advance adjustment add-on device 36.

The prestroke can therefore be controlled independently of the movement of the flyweight 11 with increasing engine speed.

Figure 3:
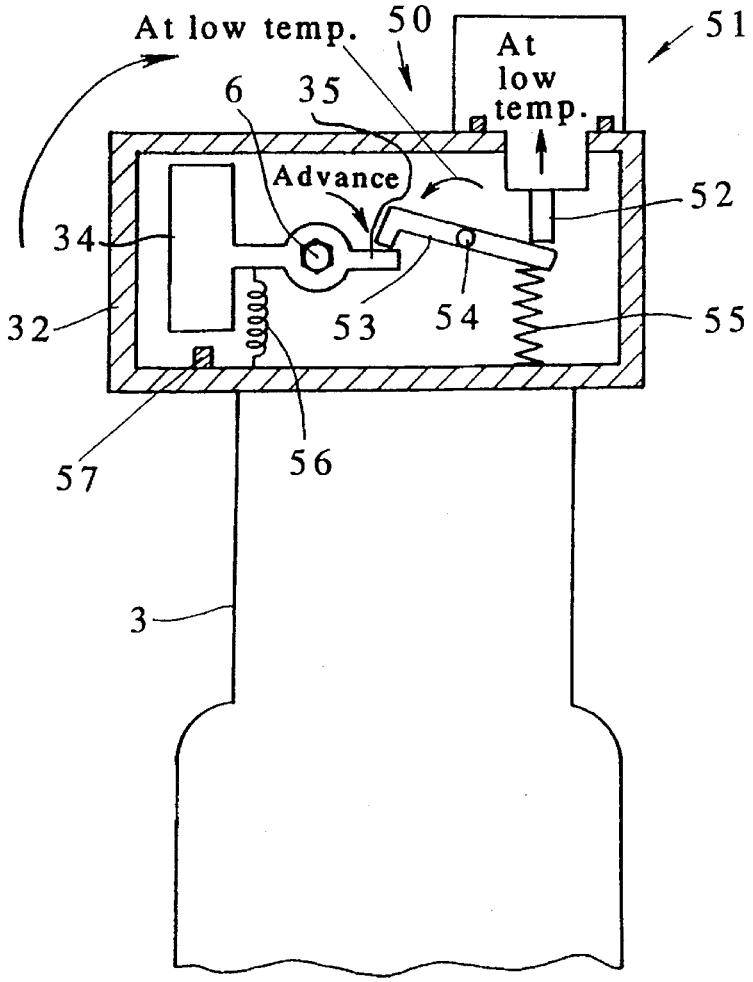
FIG. 3 is a sectional side view showing a prestroke controller 50 (second embodiment) employing an injection advance adjustment add-on device 36 for establishing a temperature injection advance characteristic.
Figure 4:
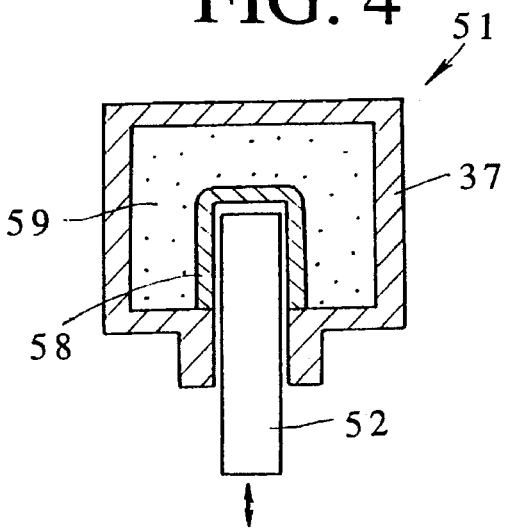
FIG. 4 is an enlarged sectional view of a wax device 51 of the prestroke controller 50.

FIGS. 3 and 4 show a prestroke controller 50 (second embodiment) employing an injection advance adjustment add-on device 36 for establishing a temperature injection advance characteristic. The mechanical governor 2 section of the prestroke controller 50 is the same as that of the prestroke controller 31 of FIG. 1, while in the counterweight case 32 portion a wax device 51 is used as the injection advance adjustment add-on device 36.

In addition, an intermediate lever 53 is provided between a control shaft 52 (corresponding to the control shaft 38 (FIG. 2)) and the abutment lever 35, and a compression spring 55 is provided to urge the intermediate lever 53 counterclockwise around a stationary shaft 54.

The counterweight 34 is provided with a tension spring 56 which urges it in the timing retard direction and with a retard side stop 57.

As shown in the enlarged view of FIG. 4, the wax device 51 has a device housing 37, the control shaft 52, a compressible rubber member 58 and wax 59 charged into the space between the compressible rubber member 58 and the device housing 37.

Expansion of the wax 59 at high temperatures causes the control shaft 52 to project outward and rotate the intermediate lever 53 clockwise, while contraction thereof at low temperatures allows the force of the compression spring 55 to press the control shaft 52 inward while rotating the intermediate lever 53 counterclockwise.

As a result, an injection timing advance characteristic can be realized during low-temperature operation owing to the fact that the inward movement of the control shaft 52 allows the intermediate lever 53 to rotate counterclockwise for rotating the abutment lever 35 (and in turn the counterweight 34) clockwise and thus causing the timing control rod 6 to push down the control sleeve 5.

Figure 5:
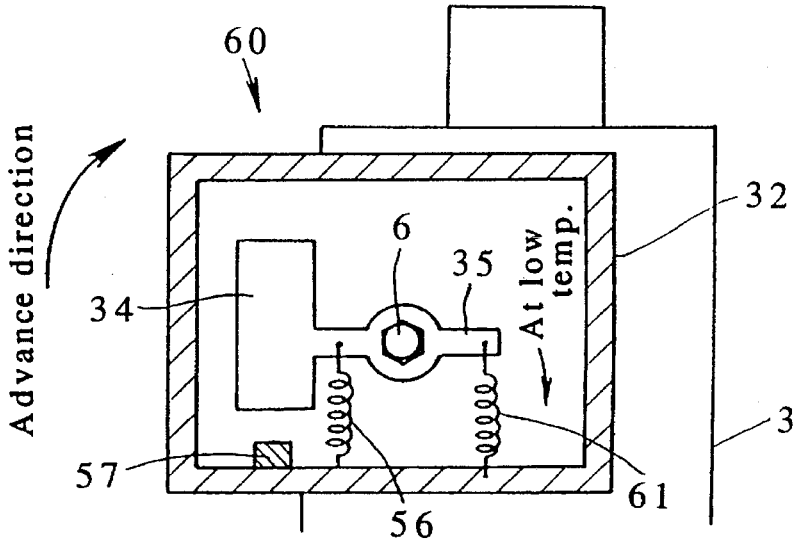
FIG. 5 is a sectional side view showing a prestroke controller 60 (third embodiment) in which the injection advance adjustment add-on device 36 employs a shape memory alloy spring 61.

FIG. 5 is a sectional view showing a prestroke controller 60 (third embodiment) in which the injection advance adjustment add-on device 36 employs a shape memory alloy spring. Specifically, the injection advance adjustment add-on device 36 is constituted of a shape memory alloy spring 61 attached between the counterweight case 32 and the abutment lever 35.

Figure 6:
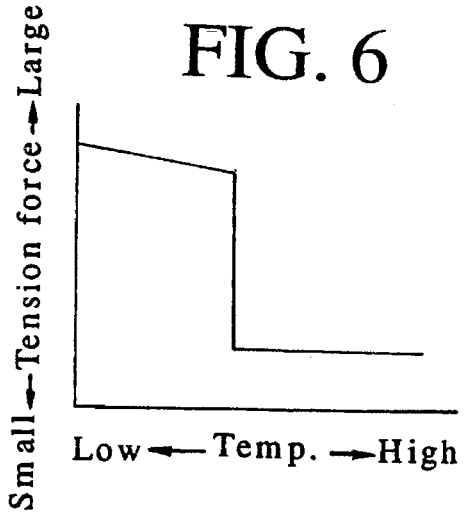
FIG. 6 is a graph showing the temperature characteristic of the shape memory alloy spring 61.

The shape memory alloy spring 61 can be constituted of any material exhibiting temperature sensitivity. For example, a ferrite magnetic material is known to experience a rapid loss of magnetization when its temperature falls below a certain level. This makes it possible to utilize the characteristic shown in FIG. 6, wherein the tension force is large at high temperatures and low at high temperatures.

The prestroke controller 60 is thus able to provide an injection timing advance characteristic at low temperatures similar to the prestroke controller 50 of FIG. 3.

Figure 7:
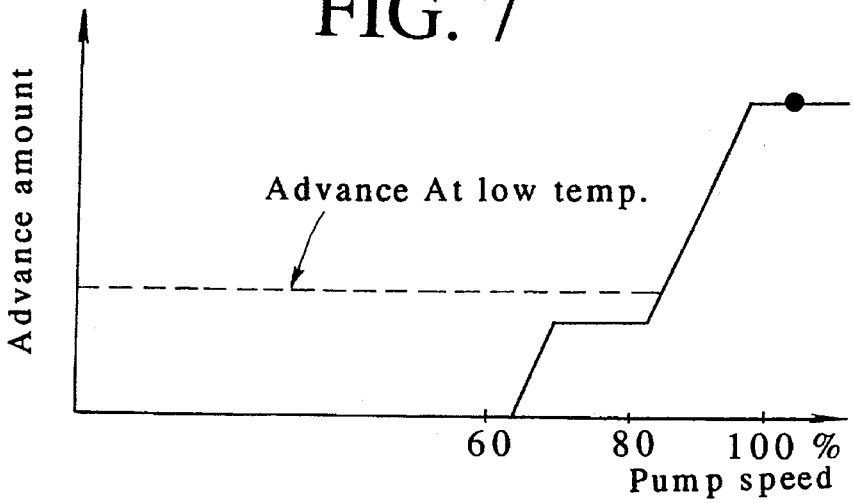
FIG. 7 is a graph showing the injection timing advance characteristics of the prestroke controllers 50 and 60.

FIG. 7 is a graph showing the injection timing advance characteristic of the prestroke controllers 50 and 60. At normal temperature the mechanical governor 2 section functions as an ordinary speed timer (solid line curve), while at low temperatures the wax device 51 of the prestroke controller 50 or the shape memory alloy spring 61 of the prestroke controller 60 establishes a low-temperature timing advance (broken line) independently of the displacement transfer by the cylindrical cam 42 portion in the mechanical governor 2.

Figure 8:
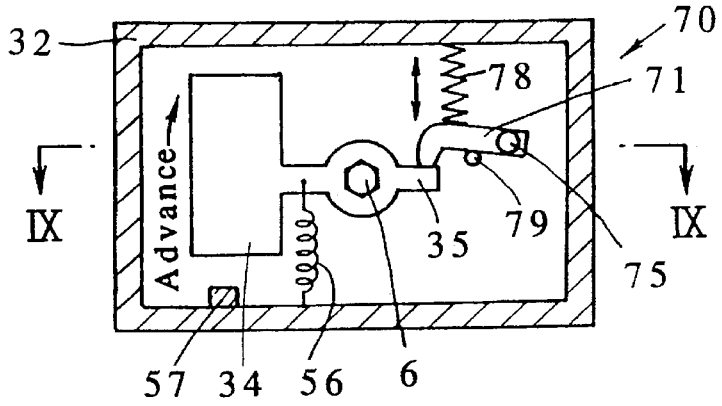
FIG. 8 is a sectional view showing a prestroke controller 70 (fourth embodiment) whose injection timing advance characteristic varies in response to the degree of depression of an accelerator pedal or the engine load condition.
Figure 9:
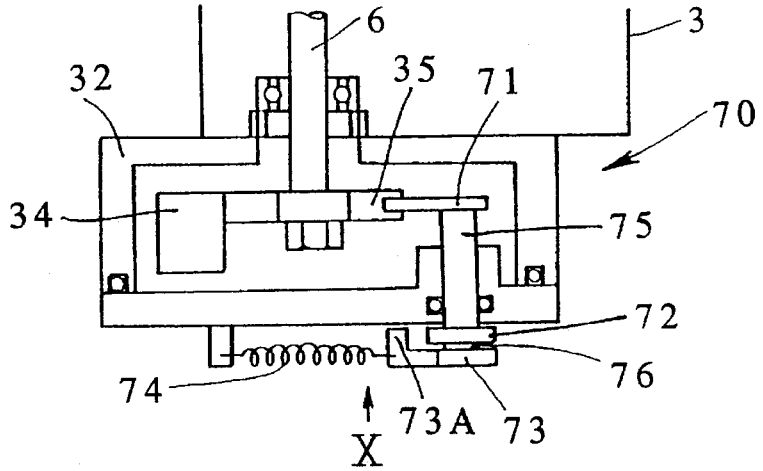
FIG. 9 is a sectional view taken along IX—IX in FIG. 8.
Figure 10:
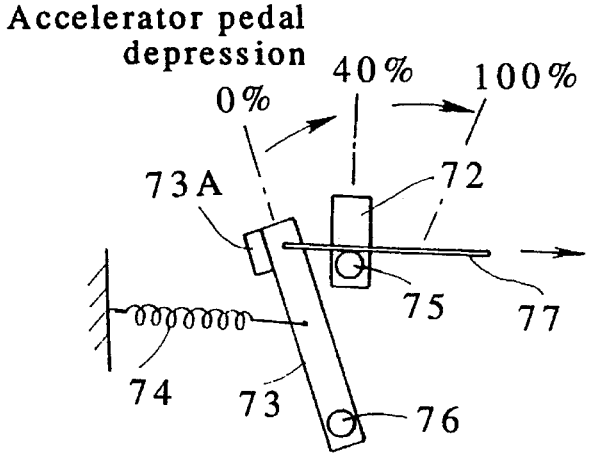
FIG. 10 is a view taken in the direction of the arrow X in FIG. 9.

FIG. 8 is a sectional view of a prestroke controller 70 (fourth embodiment) whose injection timing advance characteristic varies in response to the degree of depression of an accelerator pedal or the engine load condition, FIG. 9 is a sectional view taken along IX—IX in FIG. 8, and FIG. 10 is a view taken in the direction of the arrow X in FIG. 9. The prestroke controller 70 has a first lever 71 in contact with the abutment lever 35, and, as shown in FIGS. 9 and 10, a second lever 72, a third lever 73 and a tension spring 74.

The first lever 71 and the second lever 72 are both rotatable about a first pivot shaft 75 and the third lever 73 is rotatable about a second pivot shaft 76.

An accelerator wire 77 is attached to the third lever 73 such that depression of an accelerator pedal (not shown) causes the third lever 73 to rotate clockwise in FIG. 10. The third lever 73 has a lug 73A for engaging with and rotating the second lever 72 but is positioned such that the lug 73A does not engage with the second lever 72 in the range of accelerator pedal depression between 0% and 40%. As a result, the operation of the accelerator wire 77 is not transferred to the second lever 72 or the first lever 71 within this range.

As shown in FIG. 8, a compression spring 78 and a lever stop 79 are provided in association with the first lever 71.

Thus in the 0% to 40% range of accelerator pedal depression shown in FIG. 10, when the engine is normally under low load, the force of the accelerator wire 77 is not transferred to the first lever 71 and thus does not reach the abutment lever 35 or the timing control rod 6. Since the state shown in FIG. 8 is therefore maintained, it is possible to realize fuel injection timing advance when the degree of accelerator pedal depression is small.

Figure 11:
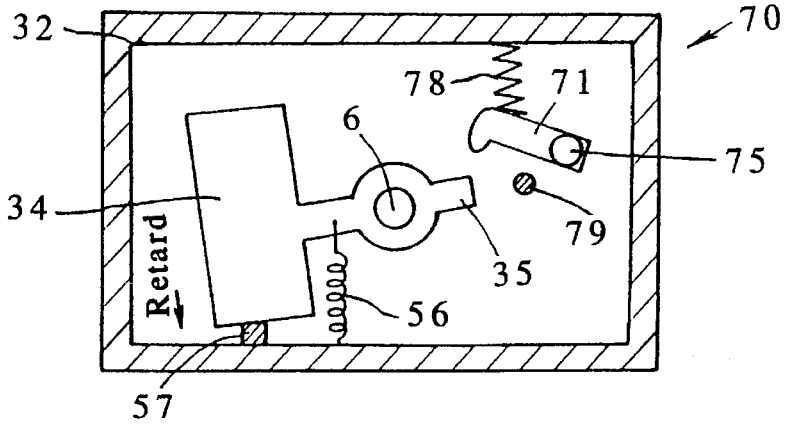
FIG. 11 is sectional view of the prestroke controller 70 showing its state when the degree of depression of the accelerator pedal exceeds 40%.
Figure 12:
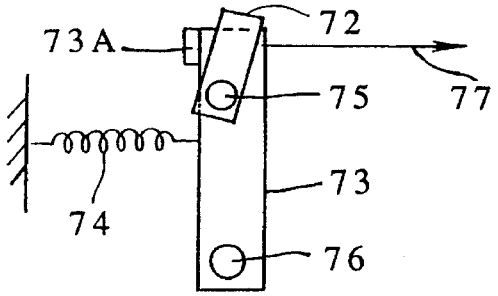
FIG. 12 is a side view similar to FIG. 10.

FIG. 11 is a sectional view showing the state of the prestroke controller 70 when the degree of depression of the accelerator pedal rises above 40% and FIG. 12 is a side view similar to FIG. 10. When the degree of depression of the accelerator pedal exceeds 40%, the lug 73A of the third lever 73 engages with the second lever 72 and rotates it clockwise therewith as seen in FIG. 12. Therefore, as shown in FIG. 11, the first lever 71 overcomes the force of the compression spring 78 and separates from the abutment lever 135, allowing the counterweight 34 to be pulled by the tension spring 56 for establishing an injection timing retard matched to the degree of accelerator pedal depression exceeding 40%.

Figure 13:
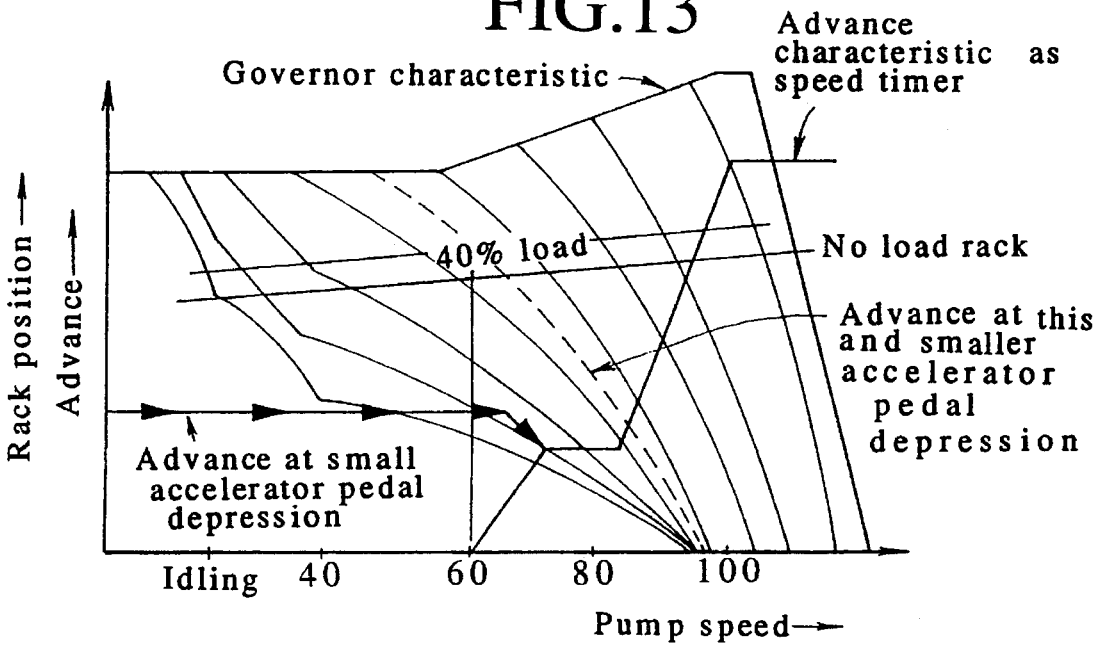
FIG. 13 is a graph showing the prestroke control based on the degree of depression of the accelerator pedal (injection timing advance characteristic) and the positional control (governor characteristic) of the injection quantity control rack 22 (FIG. 1).

FIG. 13 is a graph showing the prestroke control based on the degree of depression of the accelerator pedal (injection timing advance characteristic) and the positional control (governor characteristic) of the injection quantity control rack 22 (FIG. 1). Under a given low degree of depression of the accelerator pedal wherein, for example, the pump speed is not more than 60% and the load (or degree of depression of the accelerator pedal) is not more than 40% (broken line), the fuel injection timing can be advanced (as shown by the arrows). On the other hand, when the pump speed exceeds 60% and the accelerator pedal depression exceeds 40%, the injection timing advance characteristic of an ordinary speed timer is restored.

Figure 14:
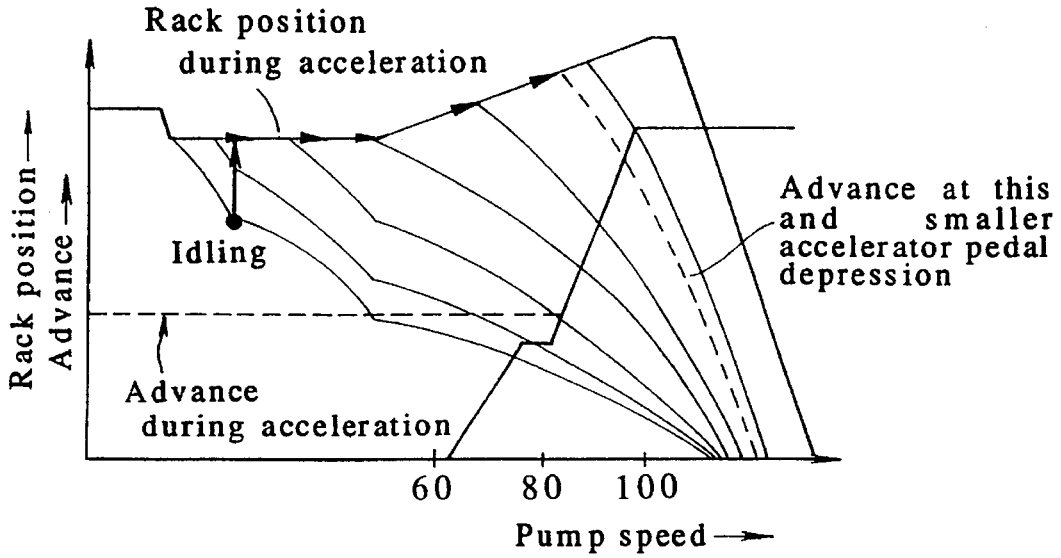
FIG. 14 is a graph showing the injection timing advance characteristic and the governor characteristic when, differently from the case of FIG. 13, the injection timing is advanced when the degree of depression of the accelerator pedal exceeds a prescribed value.

FIG. 14 is a graph showing the injection timing advance characteristic and the governor characteristic when, differently from the case of FIG. 13, the injection timing is advanced when the degree of depression of the accelerator pedal exceeds a prescribed value.

When the accelerator pedal is depressed for acceleration, for example, the fuel injection quantity can be controlled beginning from the idling state so as to follow the governor characteristic curve (as shown by the arrows) while the fuel injection timing can be advanced when the degree of depression of the accelerator pedal exceeds a prescribed level (broken line curve).

Although the configuration for obtaining this injection timing advance characteristic is not shown in the drawings, it suffices to adopt an arrangement that is the reverse of that of the prestroke controller 70 shown in FIGS. 8 to 12.

This can be realized, for example, by a configuration in which the third lever 73 disengages from the second lever 72 at a point in its rotational range corresponding to greater than a given degree of depression of the accelerator pedal. With this arrangement, further rotation of the third lever 73 does not produce additional injection timing retard and the second lever 72 and the first lever 71 are restored to the injection timing advance condition.

Figure 15:
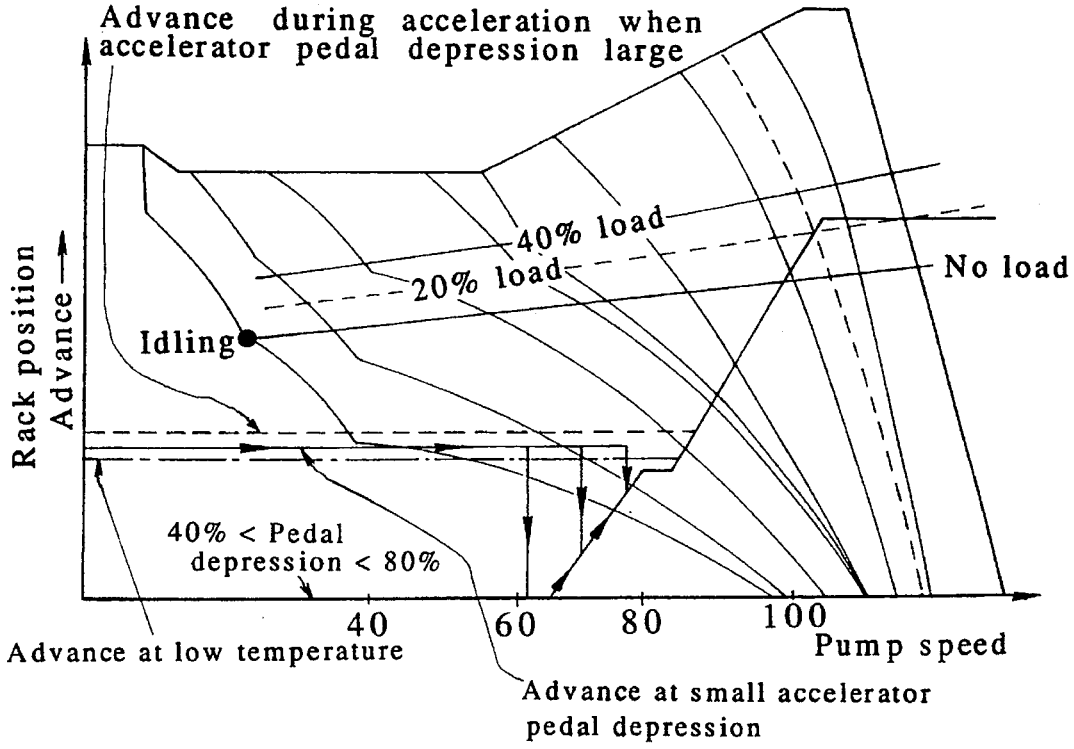
FIG. 15 is a graph showing the injection timing advance characteristic and the governor characteristic in the case of employing all of the prestroke controllers 50 (FIG. 3), 60 (FIG. 5) and 70 (FIG. 8).

FIG. 15 is a graph showing the injection timing advance characteristic and the governor characteristic in the case of employing all of the prestroke controllers 50 (FIG. 3), 60 (FIG. 5) and 70 (FIG. 8). As shown, it is possible to realize an ordinary injection timing advance characteristic responsive to engine speed and, independently of this ordinary injection timing advance characteristic, to also realize a low-temperature injection timing advance characteristic and a low-load injection timing advance characteristic.

Figure 16:
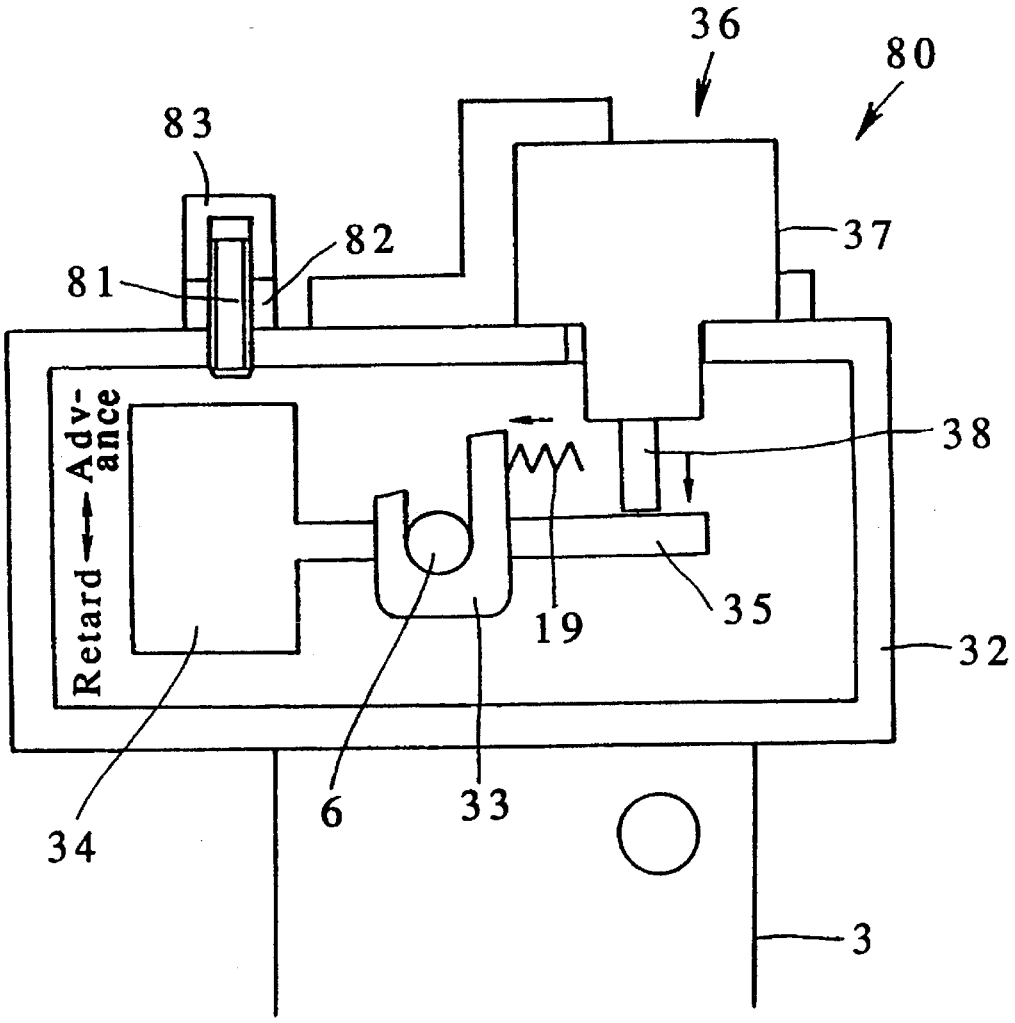
FIG. 16 is a sectional view of a prestroke controller 80 according to a fifth embodiment of the invention (second aspect).

FIG. 16 is a sectional view of a prestroke controller 80 according to a fifth embodiment of the invention (second aspect), configured for overcoming the problem described earlier with reference to FIGS. 40 to 43.

More specifically, in the prestroke controller 80 a limiting stop 81 is provided on the counterweight case 32 opposite the counterweight 34 for restricting the minimum prestroke.

The limiting stop 81, which is capable of determining the minimum prestroke (maximum timing advance), is equipped with an adjusting nut 82 and a cap nut 83 which enable fine adjustment of the gap between the limiting stop 81 and the counterweight 34.

Figure 43:
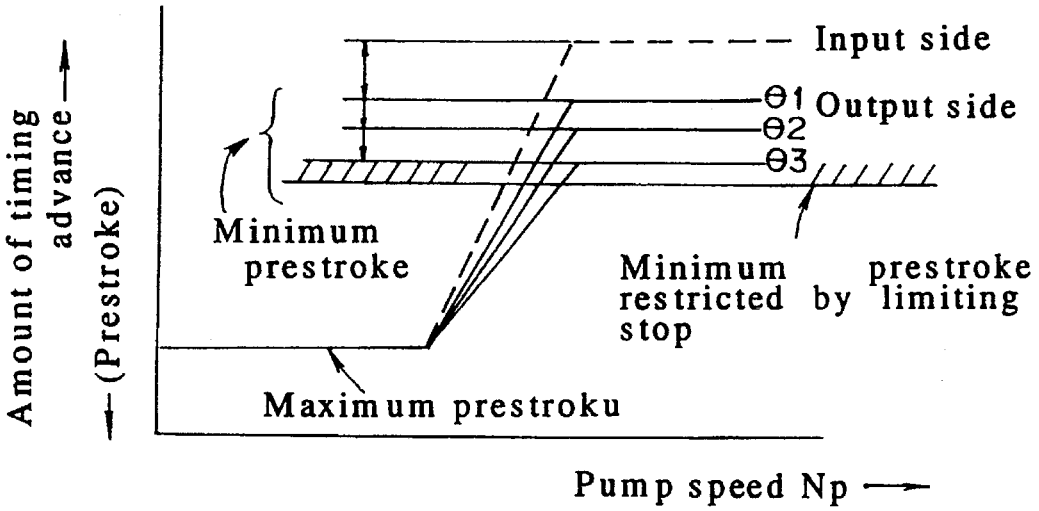
FIG. 43 is a graph showing how the amount of timing advance (prestroke) varies with pump speed Np.

Thus even if variations in ambient temperature should change the temperature characteristics of the driving side external magnet 27 and the driven side internal magnet 28 of the magnetic coupling 26, the minimum prestroke will be still be stably maintained at the prescribed value by the limiting stop 81, as indicated by hatching in FIG. 43.

Moreover, fine adjustment of the minimum prestroke is possible since the limiting stop 81 is into the counterweight case 32 directly above the counterweight 34. The precision of the adjustment is therefore improved accordingly.

The third to sixth aspects of the invention will now be explained with reference to FIGS. 17 to 38.

An embodiment of the third aspect of the invention (sixth embodiment of the invention) will first be explained based on FIGS. 17 to 25 (particularly FIGS. 21 to 23).

Figure 17:
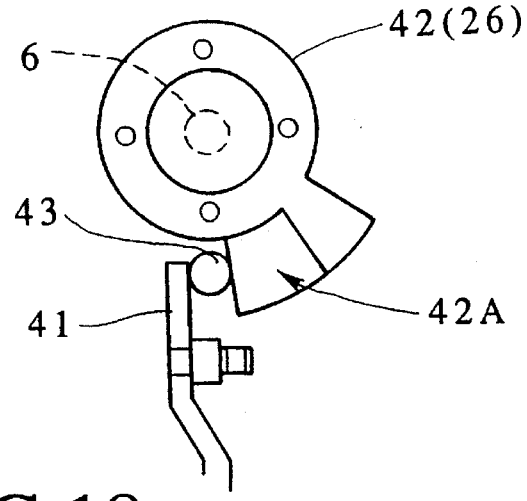
FIG. 17 is side view of an essential portion of the cylindrical cam 42 of the basic embodiment (first embodiment shown in FIG. 1) of the invention (first aspect), seen in the axial direction of the timing control rod 6 thereof.
Figure 18:
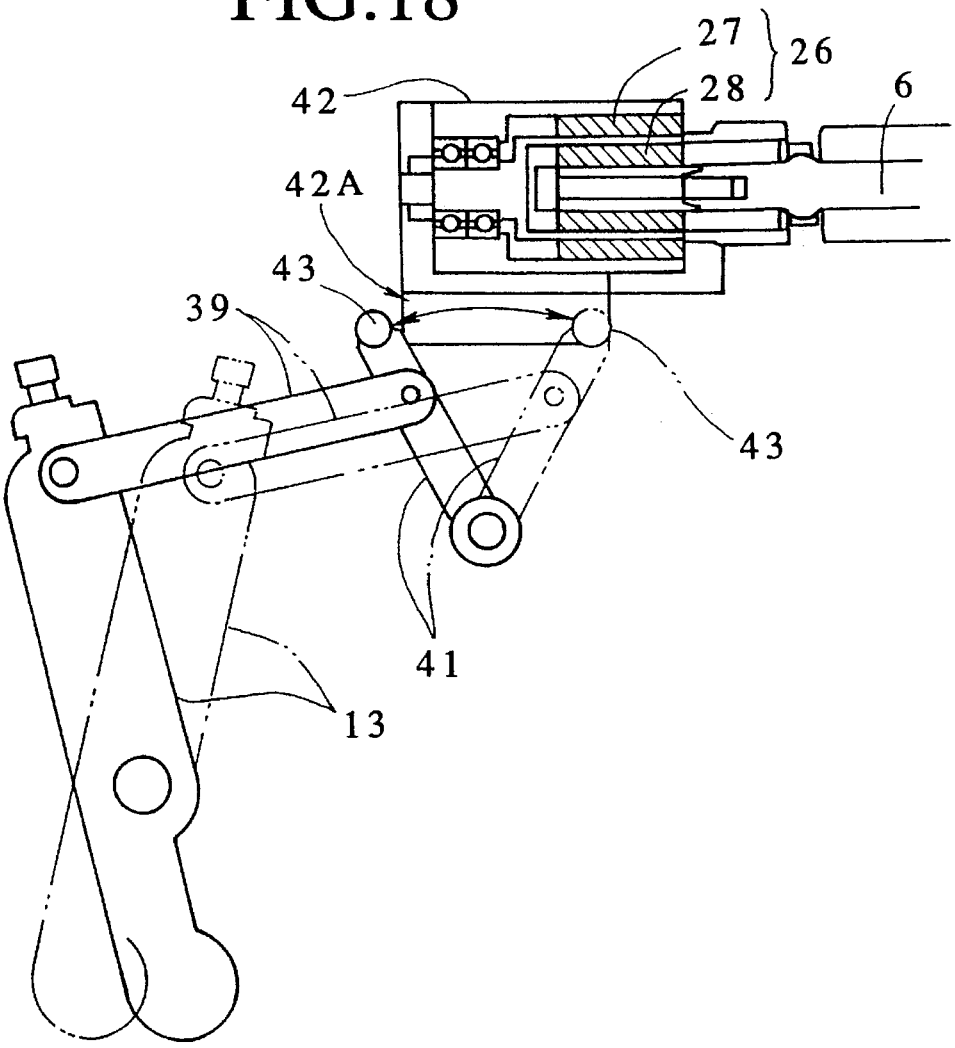
FIG. 18 is a front sectional view of the essential portion of the cylindrical cam 42 shown in FIG. 17.

FIG. 17 is side view of an essential portion of the cylindrical cam 42 of the basic embodiment (first embodiment shown in FIG. 1) of the invention (first aspect), seen the axial direction of the timing control rod 6 thereof, and FIG. 18 is a front sectional view of the same. As shown in these figures, the direction of movement of the abutment pin 43 with respect to the cylindrical cam 42 includes a portion nearly parallel to the axial direction of the timing control rod 6. As a result, the displacement or operating force of the tension lever 13 produced by the lift of the flyweight 11 is not efficiently transferred for rotating the cylindrical cam 42. Since the drive force component that the abutment pin 43 exerts on the cam surface 42A is therefore small, a fairly large force is required for rotating the cylindrical cam 42.

A reaction force therefore tends to pass from the cylindrical cam 42 to the tension lever 13 and disturb the governor characteristics.

More specifically, when the cam surface 42A of the cylindrical cam 42 of the embodiments of the first aspect of the invention exhibits a sharp gradient prestroke characteristic, the abutment pin 43 cannot reliably drive the cylindrical cam 42 (and in turn the timing control rod 6) as is required for proper prestroke control and, moreover, the governor characteristic (rack characteristic) is undesirably changed because of the very large reaction force the cam surface 42A produces in the direction of the tension lever 13.

Figure 19:
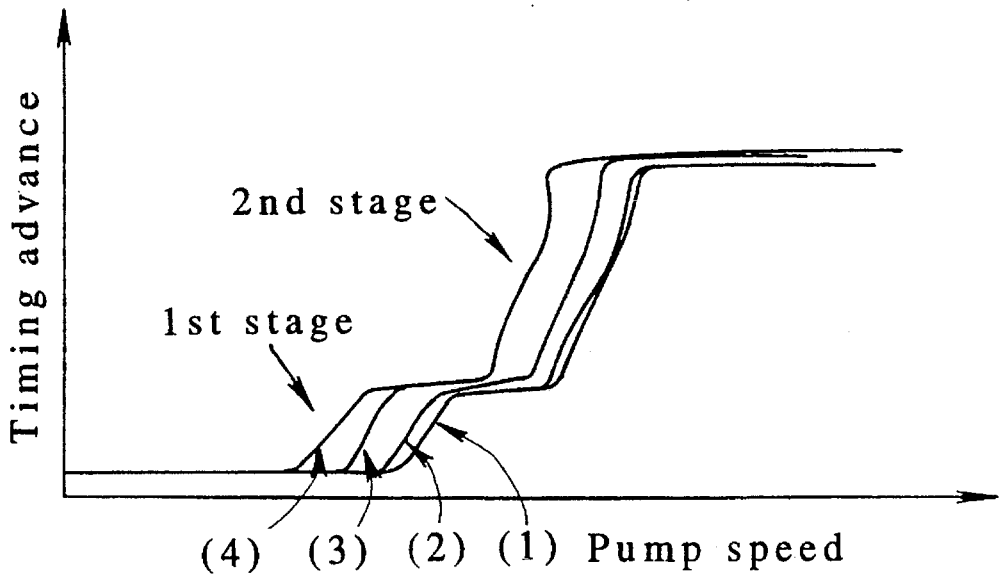
FIG. 19 is a graph showing prestroke control characteristic (injection timing advance characteristic) curves (1), (2), (3) and (4) as a function of pump speed for different degrees of accelerator pedal depression.
Figure 20:
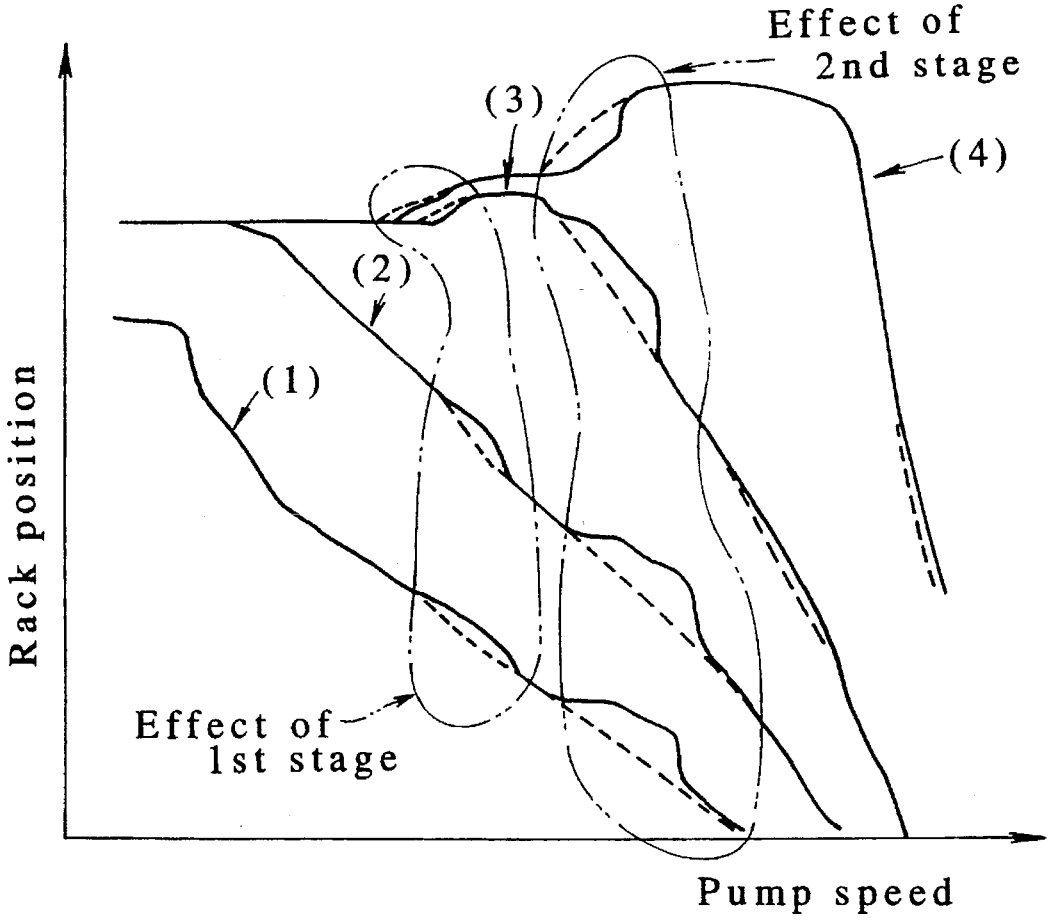
FIG. 20 is a graph showing governor characteristic curves corresponding to the injection timing advance characteristic curves (1), (2), (3) and (4) of FIG. 19.

FIG. 19 is a graph showing prestroke control characteristic (injection timing advance characteristic) curves (1), (2), (3) and (4) as a function of pump speed for different degrees of accelerator pedal depression, and FIG. 20 is a graph showing governor characteristic curves corresponding to the injection timing advance characteristic curves (1), (2), (3) and (4) of FIG. 19. It will be noted that in the case of two-stage characteristics as shown in FIG. 19, the effect of the sharp gradients of the first and second stages appears in the governor characteristics of FIG. 20.

This can be seen by comparing the solid line curves in FIG. 20, which represent the governor characteristics of a fuel injection pump equipped with a prestroke controller according to the first aspect of the invention, with the broken line curves, which represent the governor characteristics of a fuel injection pump not equipped therewith. It will be noted that in the former case the governor characteristics deviate from the original ones because the tension lever 13 is pushed back by a force from the side of the timing control rod 6.

The object of the third aspect of the invention is therefore to provide a prestroke controller utilizing the magnetic coupling 26 which minimizes the effect on (change produce in) the governor characteristic by the prestroke control characteristic even when the prestroke control characteristic is defined by a sharp gradient cam surface for prestroke control, i.e., which enables rotation of the magnetic coupling 26 at optimum efficiency and minimizes the reaction force imparted to the tension lever 13.

Figure 21:
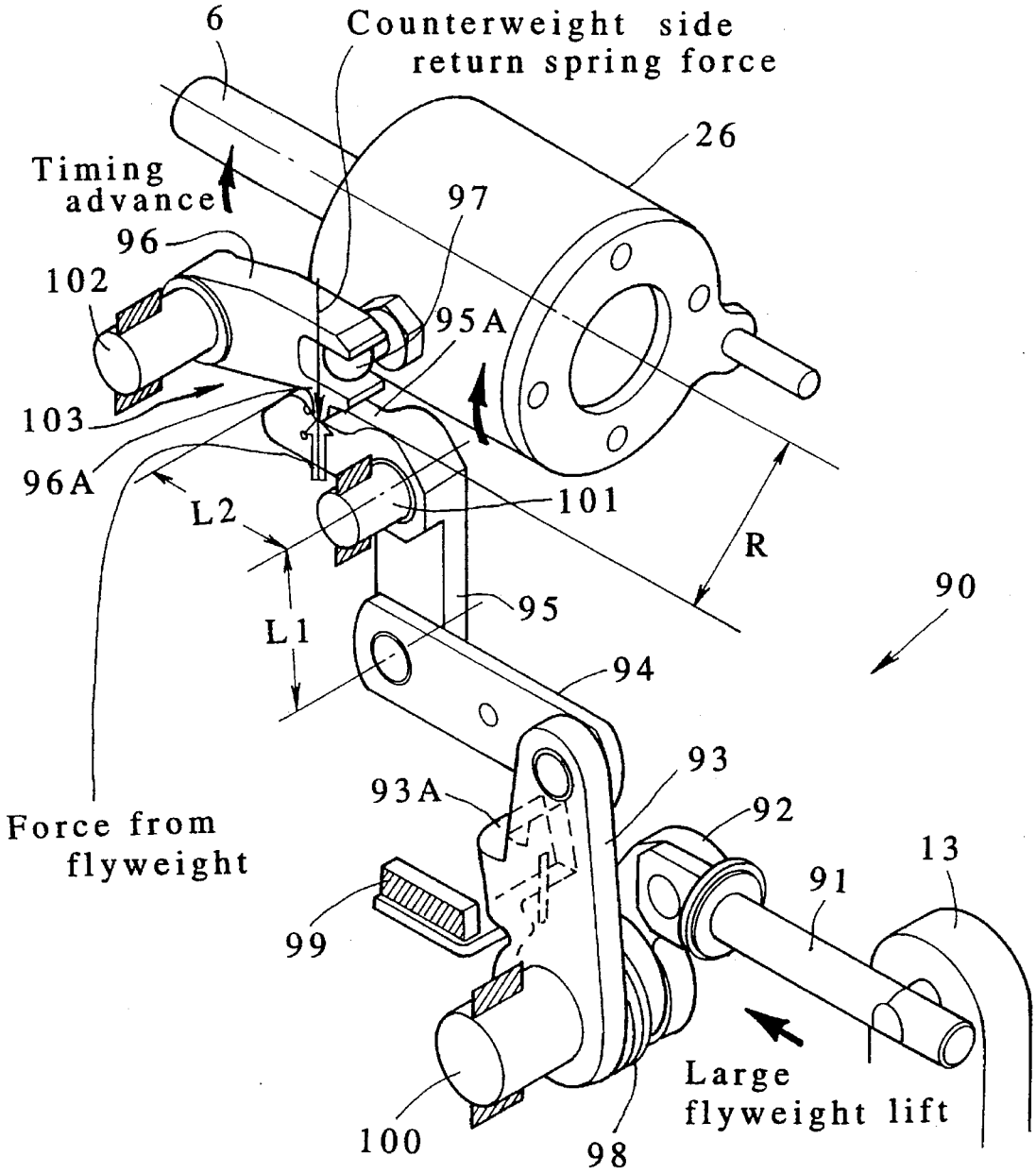
FIG. 21 is a perspective view showing an essential portion (extending from a tension lever 13 to a magnetic coupling 26) of a prestroke controller 90 which is a sixth embodiment of the invention (third aspect).
Figure 22:
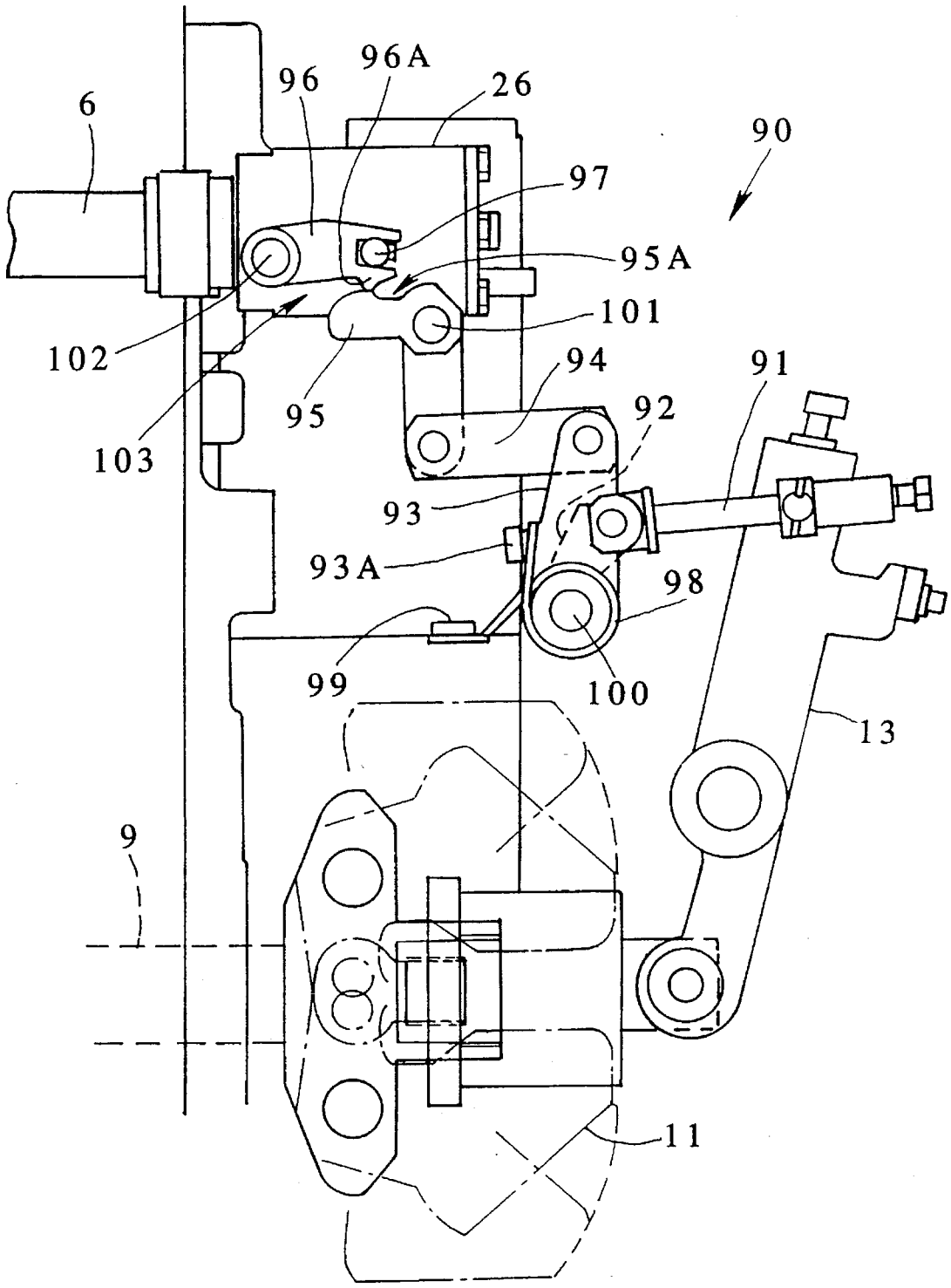
FIG. 22 is a front view of the essential portion of the prestroke controller 90 shown in FIG. 21.
Figure 23:
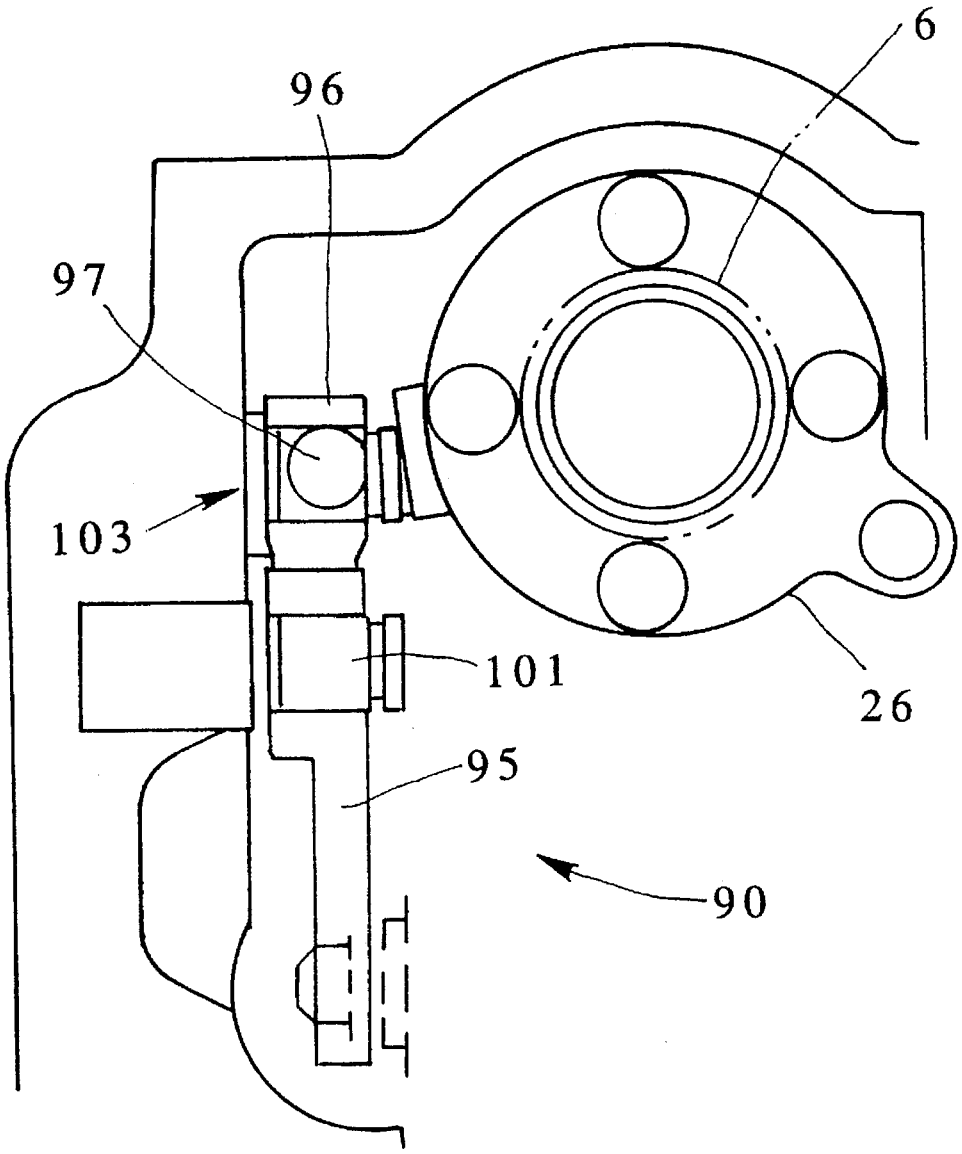
FIG. 23 is a side view of the essential portion of the prestroke controller 90 shown in FIG. 21.

FIG. 21 is a perspective view showing an essential portion (extending from the tension lever 13 to the magnetic coupling 26) of a prestroke controller 90 which is a sixth embodiment of the invention (third aspect), FIG. 22 is a front view of the same essential portion, and FIG. 23 is a side view of the same essential portion. The prestroke controller 90 has a connecting rod 91 connected to the tension lever 13, a first lever 92, a second lever 93, a link 94, a timing cam 95, a timing lever 96, and a connecting pin 97 provided on the outer surface of the magnetic coupling 26.

A coil spring 98 is inserted between a spring stop 99 and the second lever 93 so as to act only on the second lever 93 for urging it to rotate counterclockwise about a first stationary pivot shaft 100 but be responsive to lift of the flyweight 11.

The first lever 92 and the second lever 93 rotate independently until the first lever 92 strikes on a lug 93A of the second lever 93.

As the lift of the flyweight 11 increases, the resulting rotation of the tension lever 13 causes the connecting rod 91 to rotate the first lever 92 about the first stationary pivot shaft 100 toward the lug 93A of the second lever 93. After the first lever 92 strikes the lug 93A of the second lever 93, the link 94 rotates the timing cam 95 about a second stationary pivot shaft 101.

As the timing cam 95 rotates, an abutment piece 96A of the timing lever 96 rides along a cam surface 95A of the cam 95 causing the timing lever 96 to rotate about a third stationary pivot shaft 102. As a result, the magnetic coupling 26 is rotated a certain amount, thereby transferring torque to the timing control rod 6 and rotating it by a certain amount. As a result, the prestroke is increased or reduced for retarding or advancing the fuel injection timing.

In other words, the timing lever 96 and connecting pin 97 constitute a flyweight side torque transfer mechanism 103 for transferring torque from the timing cam 95 to the magnetic coupling 26.

Since the connecting pin 97 is provided to project from the outer surface of the magnetic coupling 26 and the timing lever 96 is provided for driving the connecting pin 97 as it follows the cam surface 95A of the timing cam 95, the rotation of the timing cam 95 is converted to vertical motion of the timing lever 96, thus enabling easy driving of the magnetic coupling 26.

The driving force can be more efficiently utilized for easy rotation of the magnetic coupling 26 by increasing the rotation radius R of the magnetic coupling 26.

In addition, the timing cam 95 is formed with a right angle bend and the length L1 of the arm on the link 94 side is made greater than the length L2 of the arm on the timing lever 96 side. Since leverage is therefore obtained about the center of rotation of the timing cam 95 (the second stationary pivot shaft 101), it suffices for the tension lever 13 side to apply only a small force to the timing cam 95.

Since the timing lever 96 is urged downward in the drawing (in the injection timing retard direction) by a compression return spring 19 on the counterweight 34 side (see FIG. 2, for example), efficient driving of the timing lever 96 is ensured by providing the timing cam 95 for driving it upward from below.

Figure 24:
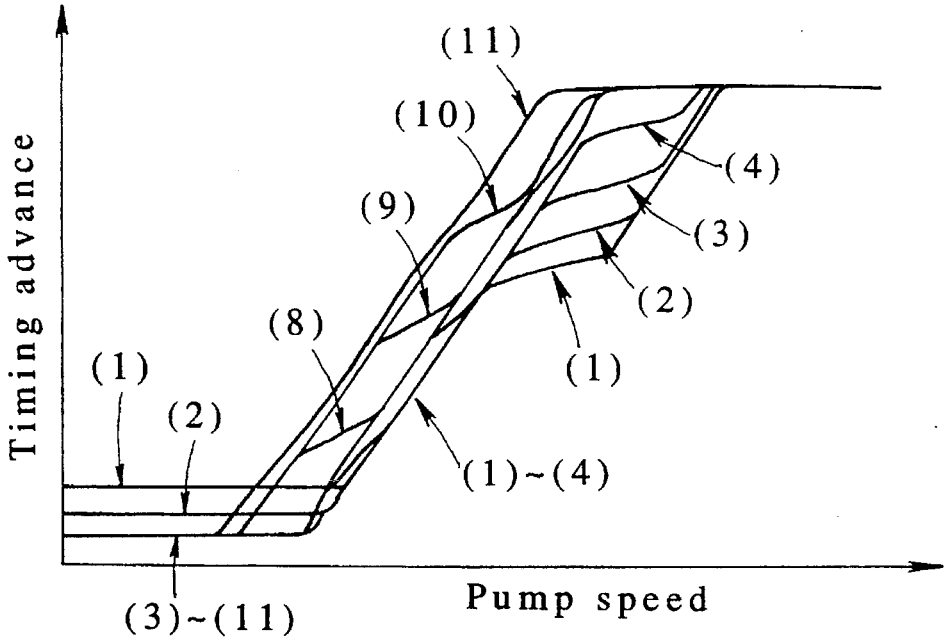
FIG. 24 is a graph similar to that of FIG. 19 showing prestroke control characteristic curves (sharp gradient advance injection timing characteristic curves (1)–(11)) as a function of pump speed for different degrees of accelerator pedal depression.
Figure 25:
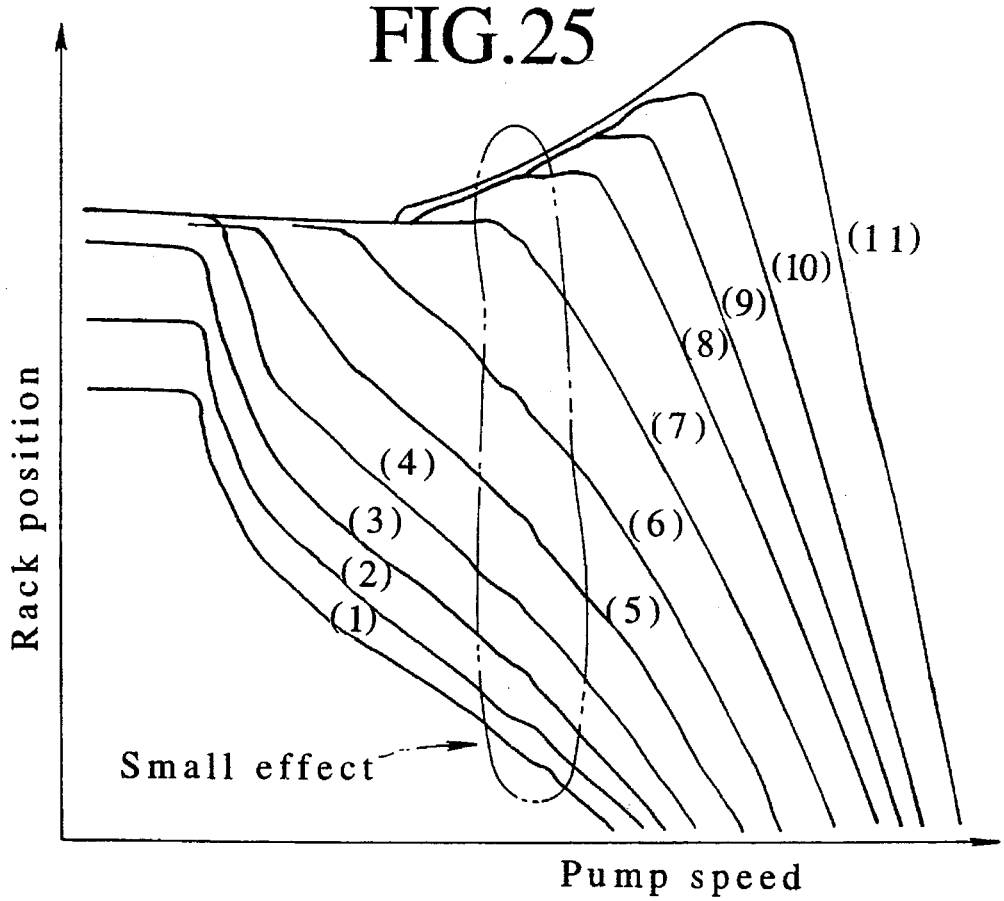
FIG. 25 is a graph similar to that of FIG. 20 showing governor characteristic curves corresponding to the sharp gradient injection timing advance characteristic curves (1)–(11) of FIG. 24.

As can be seen from the FIGS. 24 and 25, which show injection timing advance characteristics and governor characteristics corresponding to those shown in FIGS. 19 and 20, the magnetic coupling 26 can be rotated with optimum efficiency from the side of the tension lever 13 and the effect of the sharp gradient injection timing advance characteristics (1)–(11) on the governor characteristics (1)–(11) can be greatly reduced (see portion enclosed by a chain line if FIG. 25).

Further, since the timing lever 96 also serves as a sensor lever contacting the timing cam 95, the prestroke control characteristic can be defined relatively freely by designing the profile of the cam surface 95A off the timing cam 95.

In the embodiments of the first aspect of the invention (see FIG. 1, for example), the cam surface 42A formed directly on the cylindrical cam 42 (magnetic coupling 26) is used as the means for obtaining the prestroke control characteristic. The profile of the cam surface 42A is, however, relatively difficult and costly to form. In contrast, since the prestroke controller 90 according to the third aspect of the invention requires no cam surface on the magnetic coupling 26 and instead adopts the timing lever 96 and the timing cam 95 provided with the cam surface 95A, it can be formed at low cost in generally the same manner as used for forming the torque cam 21 of the mechanical governor 2 (see FIG. 39).

The fourth aspect of the invention relates to a mechanism for adjusting the prestroke control characteristic so as to match the required target characteristic.

A prestroke controller 110 which is a seventh embodiment of the invention (fourth aspect) will now be explained with reference to FIGS. 26 to 28.

The prestroke controller 110 is also equipped with a safety mechanism featured by the prestroke controller according to the fifth aspect of the invention.

Figure 26:
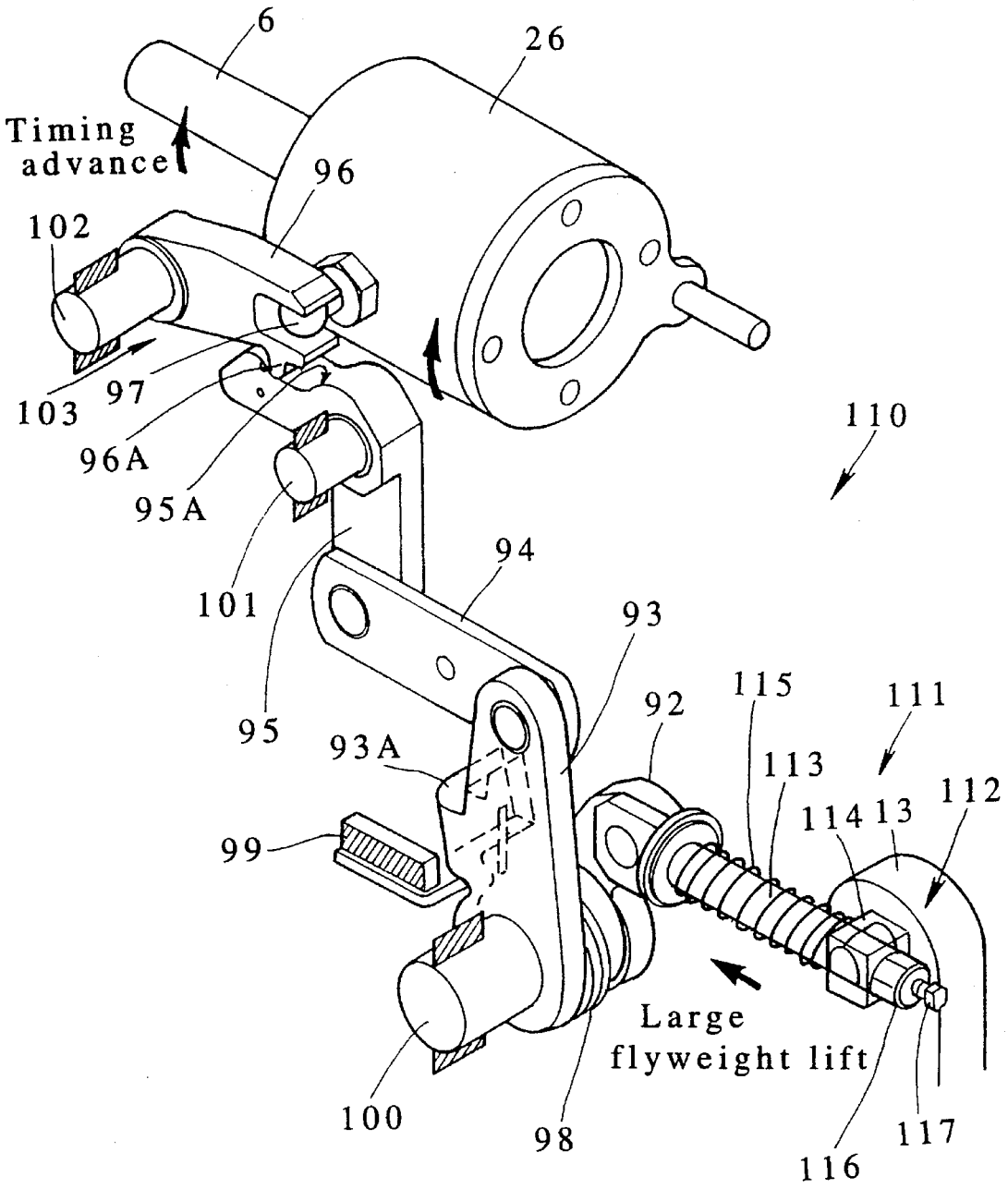
FIG. 26 is a perspective view showing an essential portion (extending from a tension lever 13 to a magnetic coupling 26) of a prestroke controller 110 which is a seventh embodiment of the invention (third aspect).

Similarly to FIG. 21 showing the prestroke controller 90 (sixth embodiment), FIG. 26 is a perspective view showing an essential portion (extending from a tension lever 13 to a magnetic coupling 26). Except for being provided with a prestroke control start time adjustment mechanism 111 at its connecting rod 91 section and with a safety mechanism 112, the prestroke controller 110 is configured in the same manner as the prestroke controller 90.

Figure 27:
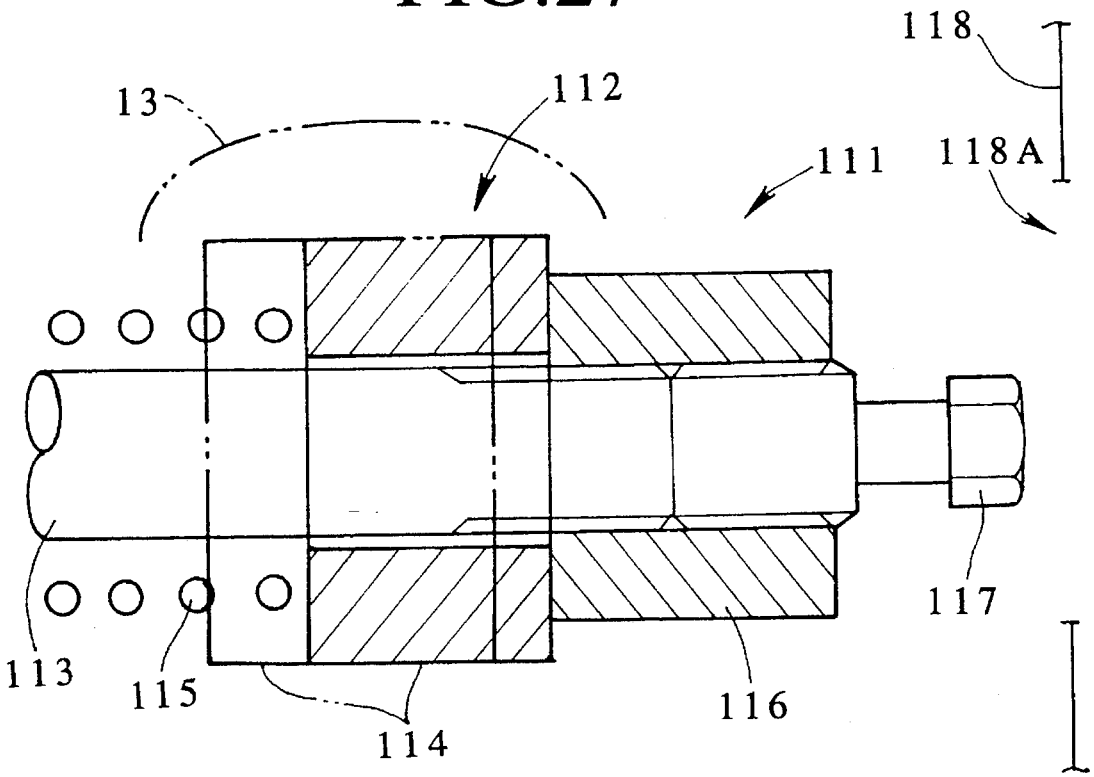
FIG. 27 is a sectional view of an essential portion of a prestroke control start time adjustment mechanism 111 of the prestroke controller 110.

FIG. 27 is a sectional view of an essential portion of a prestroke control start time adjustment mechanism 111. As shown in this figure, the prestroke control start time adjustment mechanism 111 comprises the first lever 92 and the second lever 93 (see FIG. 21), a phase adjustment rod 113, a fixed block 114, a coil spring 115, an adjustment cap nut 116 and a fastening bolt 117.

The safety mechanism 112 is constituted of the first lever 92, the phase adjustment rod 113, the fixed block 114 and the coil spring 115.

The phase adjustment rod 113, which replaces the connecting rod 91 (see FIG. 21), is connected to the first lever 92 at one end. Its other end passes through the fixed block 114 to be slidable back and forth therein and has the adjustment cap nut 116 screwed on the tip thereof.

The fixed block 114 is fixed to the tension lever 13 and the coil spring 115 is held between the fixed block 114 and the first lever 92.

The adjustment cap nut 116, which is a separate member from the fixed block 114, is screw-engaged with the tip of the phase adjustment rod 113 and the fastening bolt 117.

In the so-configured prestroke control start time adjustment mechanism 111, the amount of projection of the phase adjustment rod 113 from the first lever 92 can be adjusted on the side of the fixed block 114 by using an adjustment tool (not shown) inserted through an adjustment opening 118A formed in the housing 118 of the mechanical governor 2 to turn the fastening bolt 117 with respect to the adjustment cap nut 116 and further turn the adjustment cap nut 116 with respect to the phase adjustment rod 113, thereby adjusting the position of the phase adjustment rod 113 relative to the fixed block 114.

After the position of the phase adjustment rod 113 has be adjusted, the fastening bolt 117 is tightened for fixing the phase adjustment rod 113 relative to the adjustment cap nut 116.

Thus, similarly to what was explained earlier regarding the prestroke controller 90 of FIG. 21, the point at which the first lever 92 is brought into contact with the second lever 93 by rotation of the tension lever 13 (i.e., the time point at which contact is made or the injection timing advance start time) can be adjusted.

Figure 28:
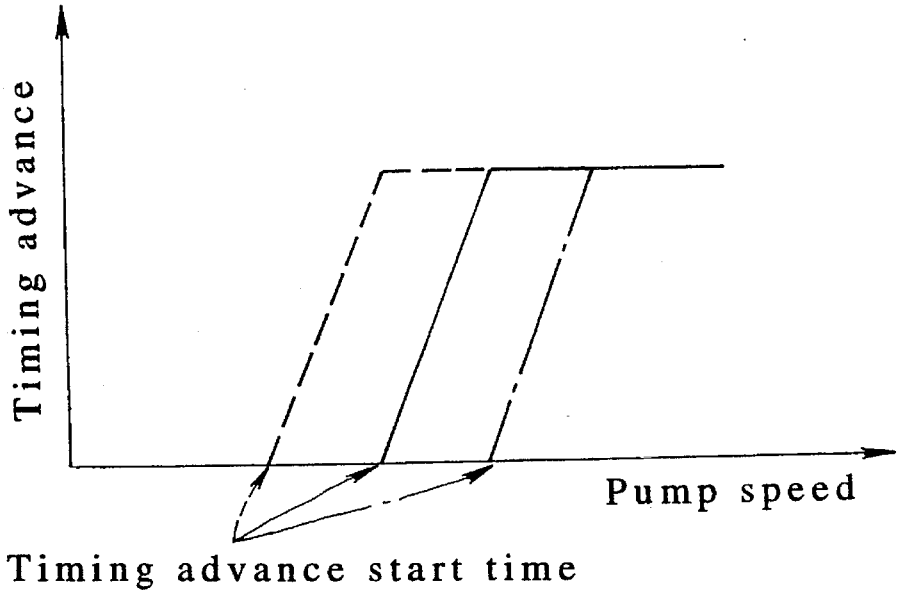
FIG. 28 is a graph relating to the prestroke controller 110 showing injection timing advance characteristic curves as a function of pump speed.

Specifically, as shown in FIG. 28, the injection timing advance start time can be adjusted for the pump speed, enabling securement of the desired engine torque and emission characteristics.

Moreover, since the adjustment of the amount of projection of the phase adjustment rod 113 can be made from outside the housing 118 through the adjustment opening 118A, the adjustment can be conducted simply in a small number of steps.

Further, since the torque cam phase adjustment rod of the prior art can be used without modification as the phase adjustment rod 113, a reduction in cost is realized owing to the common utilization of parts (including the adjustment tool).

In addition, the provision of the safety mechanism 112 ensures the operation of the tension lever 13 and, accordingly, guarantees that the torque cam 21 and the mechanical governor 2 will be able to fulfill their functions even if the magnetic coupling 26 should stick (i.e. even if the prestroke control mechanism should become inoperative).

More specifically, if the magnetic coupling 26 should stick (be immobilized), the rotational force of the tension lever 13 produced by the lift of the flyweight 11 will overcome the force of the coil spring 115 and push the fixed block 114 away from the fixed block 114 in the direction of the first lever 92 (see the phantom line in FIG. 27). As a result, the movement of the tension lever 13 and, accordingly, the function of the mechanical governor 2 (control of fuel injection quantity), are ensured.

A prestroke controller 120 which is another embodiment of the third aspect of the invention (eighth embodiment of the invention) will now be explained with reference to FIG. 29.

Figure 29:
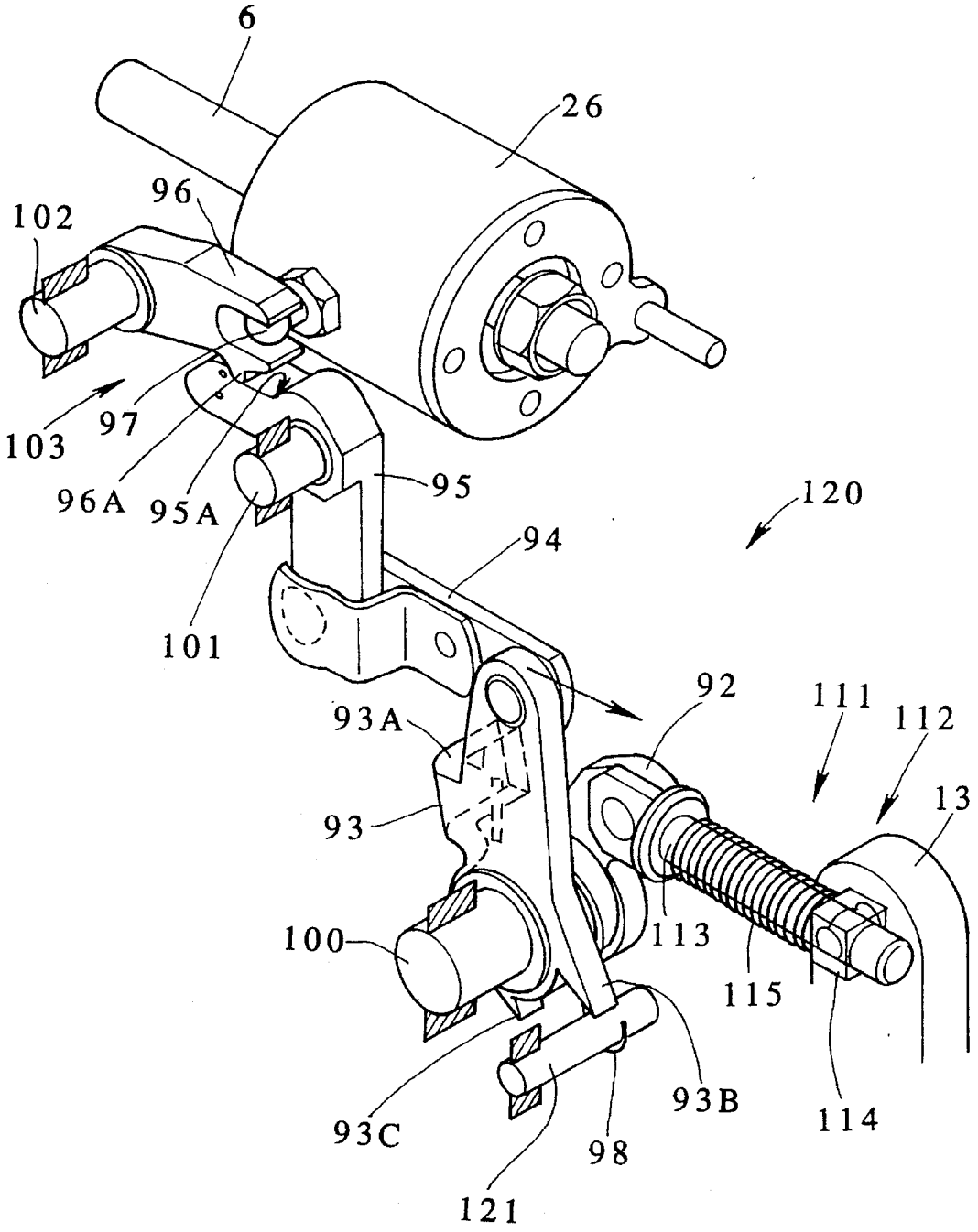
FIG. 29 is a perspective view showing an essential portion (extending from a tension lever 13 to a magnetic coupling 26) of a prestroke controller 120 which is an eighth embodiment of the invention (third aspect).

FIG. 29 is a perspective view similar to that of the prestroke controller 110 (seventh embodiment) in FIG. 26, showing an essential portion extending from the tension lever 13 to the magnetic coupling 26. The prestroke controller 120 is the same as the prestroke controller 110 except as regards the structure of the second lever 93.

In the prestroke controller 120, a stop pin 121 is provided near the lower end of the second lever 93 and the second lever 93 is formed with an initial position limiting projection 93B and a final position limiting projection 93C at portions thereof destined to strike against the stop pin 121 with rotation of the second lever 93.

One end of the coil spring 98 is hooked onto the stop pin 121 and the other end thereof is engaged with the lug 93A of the second lever 93 so as to urge the second lever 93 to rotate clockwise about the first stationary pivot shaft 100 against the lift of the flyweight 11.

In the initial state prior to lift of the flyweight 11, therefore, the initial position limiting projection 93B of the second lever 93 is in contact with the stop pin 121, the first lever 92 and the second lever 93 are separated, and a small clearance is present between the cam surface 95A of the timing cam 95 and the abutment piece 96A of the timing lever 96.

As the flyweight 11 lifts, the tension lever 13 and the first lever 92 rotate toward the second lever 93 and prestroke control starts with the abutment of the first lever 92 on the lug 93A.

The second lever 93 then rotates until stopped by the abutment of the final position limiting projection 93C on the stop pin 121.

Thus the prestroke control range can be set within a desired range within the range of rotation permitted by the initial position limiting projection 93B and the final position limiting projection 93C, and the sliding movement of the cam surface 95A of the timing cam 95 and the abutment piece 96A of the timing lever 96 can be held within an appropriate range.

A prestroke controller which is a ninth embodiment of the invention (fifth aspect) will now be explained with reference to FIGS. 30 and 31.

Figure 30:
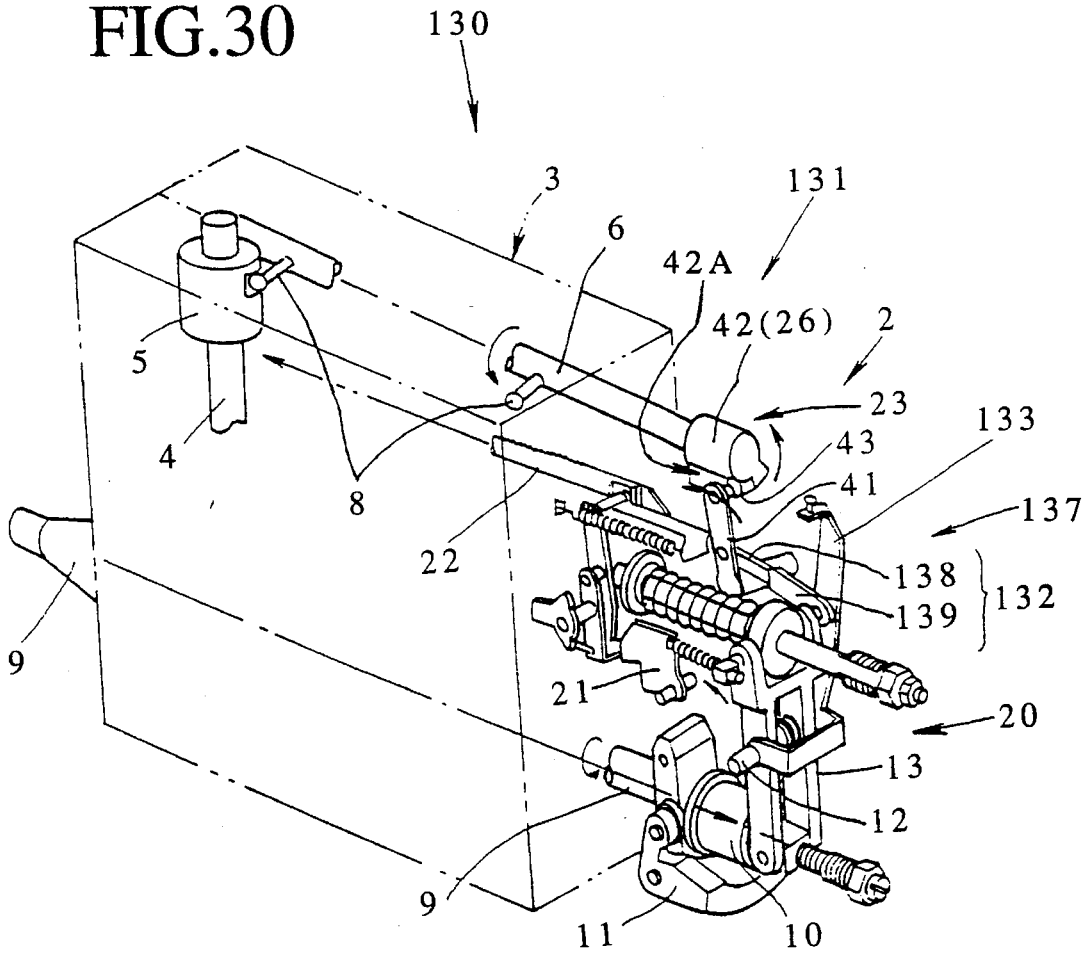
FIG. 30 is a simplified perspective view of a fuel injection pump 130 equipped with a prestroke controller 131 which is a ninth embodiment of the invention (fifth aspect).

FIG. 30 is a simplified perspective view of a fuel injection pump 130. The fuel injection pump 130 comprises an in-line main pump unit 3, a prestroke controller 131 and a mechanical governor 2.

On the mechanical governor 2 side of the prestroke controller 131, the prestroke can be controlled in accordance with the engine speed (pump speed) by co-utilizing the flyweight 11 of the mechanical governor 2.

More specifically, a tension lever 13 (similar to that shown in FIG. 39) has an intermediate link 132 and a guide lever 40 attached thereto, and a sensor lever (control lever) 41 is attached to the intermediate link 132.

A cylindrical cam 42 (similar to that shown in FIG. 1) is fitted on the end portion of the timing control rod 6 opposite the mechanical governor 2 and all abutment pin 43 of the sensor lever 41 is abutted on the cam surface 42A of the cylindrical cam 42.

A magnetic coupling 26 (FIG. 40) is built into the cylindrical cam 42 and the rotation of the cylindrical cam 42 is transferred to the timing control rod 6 through the magnetic coupling 26. The control sleeve 5 can therefore be moved vertically with respect to the plunger 4 to adjust the prestroke in the manner explained earlier.

A safety mechanism 137 is provided at the intermediate link 132 between the tension lever 13 and the sensor lever 41. By ensuring the operation of the tension lever 13 the safety mechanism 137 guarantees that the torque cam 21 and the mechanical governor 2 will perform their functions even if the cylindrical cam 42 should stick and become immovable for some reason.

Figure 31:
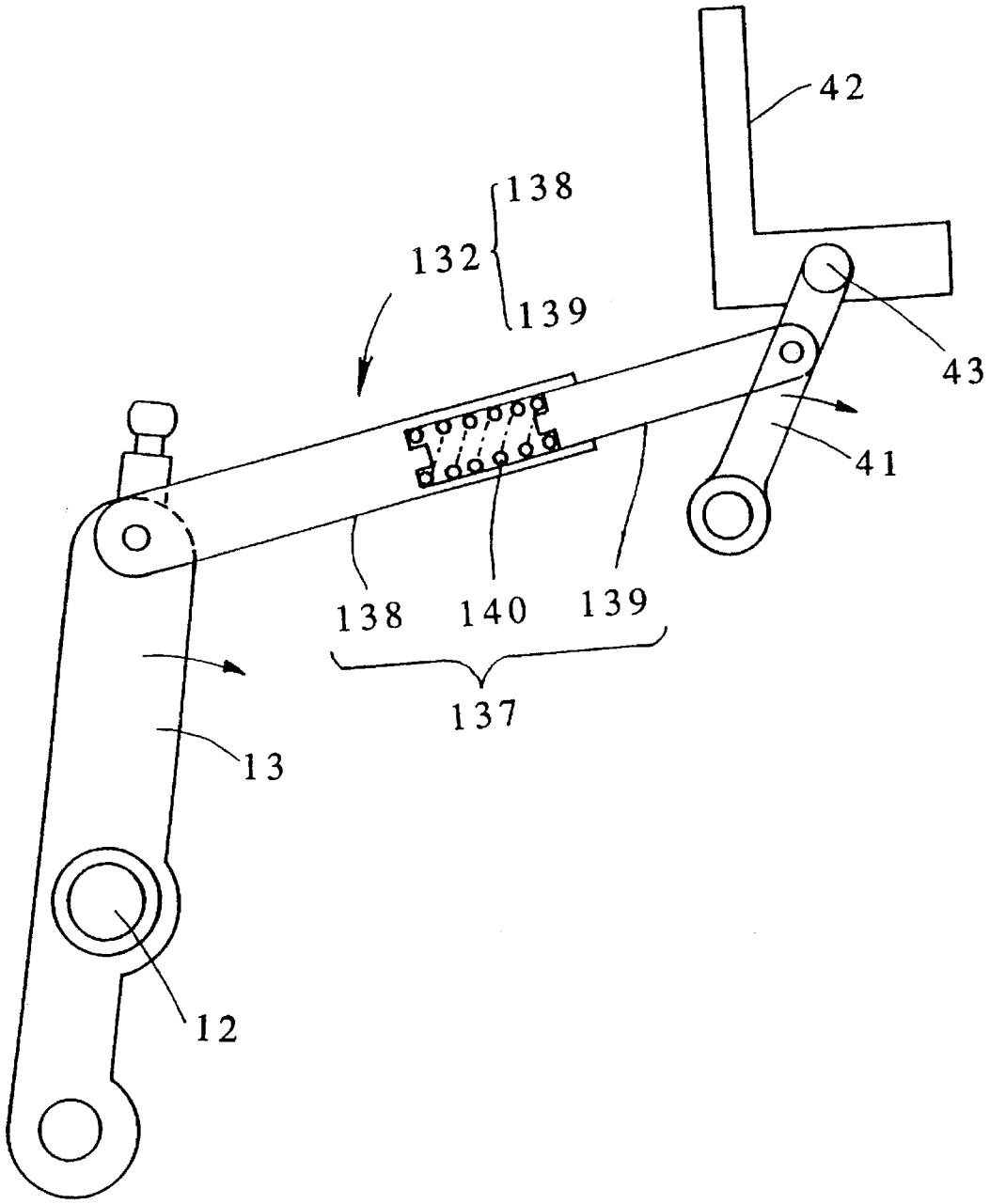
FIG. 31 is an enlarged side view showing an essential portion of a specific arrangement of a safety mechanism 137 of the fuel injection pump 131.

FIG. 31 is an enlarged side view showing the essential portion of a specific arrangement of the safety mechanism 137. The safety mechanism 137 is constituted by dividing the intermediate link 132 into a first intermediate link section 138 connected with the tension lever 13 side and a second intermediate link section 139 connected with the sensor lever 41 side and inserting a compression spring 140 between the two sections.

Therefore when the tension lever 13 rotates clockwise about the stationary pivot shaft 12 as seen in FIG. 31, the first intermediate link section 138 transfers its displacement to the second intermediate link section 139 while compressing the compression spring 140, the second intermediate link section 139 rotates the sensor lever 41 clockwise, and the abutment pin 43 of the sensor lever 41 rotates the cylindrical cam 42.

The prestroke controller 131 configured in the foregoing manner operates similarly to the fuel injection pump prestroke controller 1 of FIG. 39 in the point that the movement of the flyweight 11 with increasing engine speed is used to rotate the tension lever 13 and, in turn, to rotate the intermediate link 132 and the control lever 41 in the direction of the arrow.

As a result, the abutment pin 43 pushes against the cam surface 42A of the cylindrical cam 42 to rotate the cylindrical cam 42 counterclockwise in FIG. 30 and the resulting rotation of the timing control rod 6 is transferred to the engagement pin 8 which lowers the control sleeve 5, thereby shortening the prestroke and advancing the fuel injection timing.

Even if the cylindrical cam 42 or the magnetic coupling 26 should happen to stick and become immovable, thus also making the second intermediate link section 139 immovable, the movement of the flyweight 11 will still be able to rotate the tension lever 13 because the first intermediate link section 138 will be able to overcome the force of the compression spring 140 and move the required distance in the direction of the second intermediate link section 139. Thus, since the displacement of the tension lever 13 needed for the governor mechanism 20 to function can be secured, the fuel injection quantity function of the governor mechanism 20 will not be disabled.

Obviously the ability of the tension lever 13 to rotate counterclockwise in FIG. 30 is also ensured.

Figure 32:
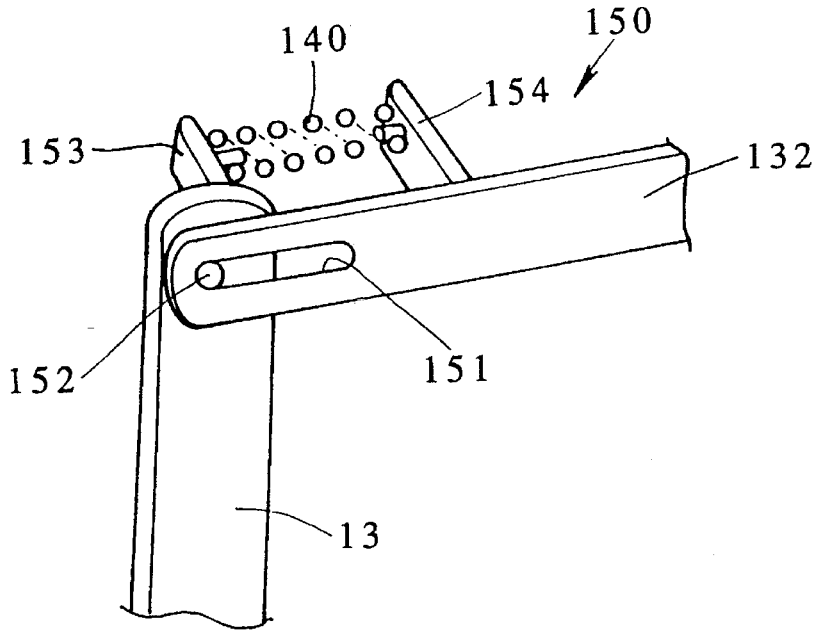
FIG. 32 is an enlarged view showing an essential portion of a safety mechanism 150 in a prestroke controller which is a tenth embodiment of the invention (fifth aspect).

FIG. 32 is an enlarged view showing the essential portion of a safety mechanism 150 in a prestroke controller which is a tenth embodiment of the invention (fifth aspect). The safety mechanism 150 is constituted by forming an elongate hole 151 in the intermediate link 132 at the portion where it connects with the tension lever 13, fitting a pivot shaft 152 of the tension lever 13 into the elongate hole 151, and inserting a compression spring 140 between a first spring seat 153 extending from the tension lever 13 and a second spring seat 154 extending from the intermediate link 132.

Similarly to the safety mechanism 137, the safety mechanism 150 configured in the foregoing manner also ensures operation of the tension lever 13 even if sticking should occur owing to a problem in the cylindrical cam 42.

Figure 33:
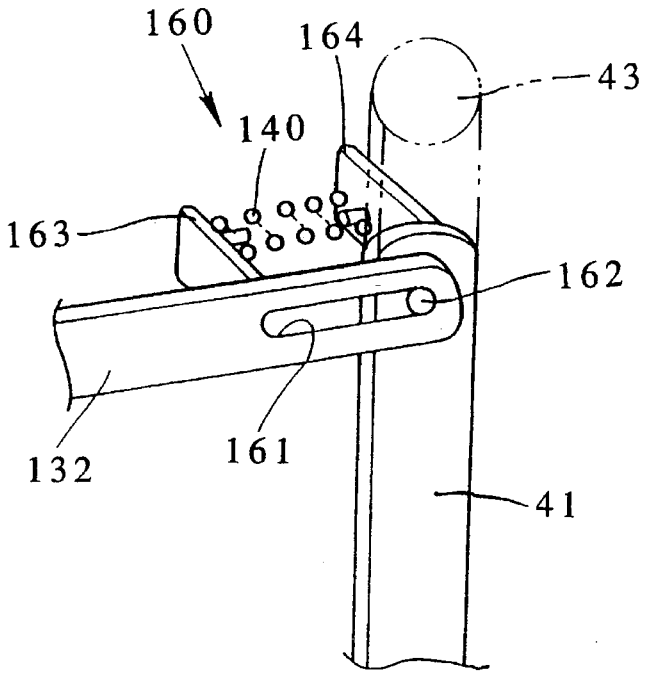
FIG. 33 is an enlarged view showing an essential portion of a safety mechanism 160 in a prestroke controller which is an eleventh embodiment of the invention (fifth aspect).

FIG. 33 is an enlarged view showing the essential portion of a safety mechanism 160 in a prestroke controller according to an eleventh embodiment of the invention (fifth aspect). The safety mechanism 160 is constituted by forming an elongate hole 161 in the intermediate link 132 at the portion where it connects with the sensor lever 41, fitting a pivot shaft 162 of the sensor Never 41 into the elongate hole 161, and inserting the compression spring 140 between a first spring seat 163 extending from the intermediate link 132 and a second spring seat 164 extending from the sensor lever 41.

Similarly to the safety mechanism 137, the safety mechanism 160 configured in the foregoing manner also ensures operation of the tension lever 13 even if sticking should occur owing to a problem in the cylindrical cam 42.

The safety mechanism according to the fifth aspect of the invention can alternatively be provided at some other link connection portion, such as between the intermediate link 132 and the tension lever 13. Any arrangement that can ensure rotation of the tension lever 13 with movement of the flyweight 11 suffices in principle.

Differently from the earlier described first to fifth aspects of the invention, the sixth aspect of the invention enables a governor lever (speed lever and first supporting lever) to be controlled so as to control the prestroke and thus the injection timing advance characteristic altogether independently of the flyweight 11.

The sixth aspect of the invention can therefore be adopted in parallel with other configurations for mechanically obtaining a low-temperature injection timing advance characteristic, a low-load injection timing advance characteristic and the like.

A prestroke controller 170 which is a twelfth embodiment of the invention (sixth aspect) will now be explained with reference to FIGS. 34 to 37.

Figure 34:
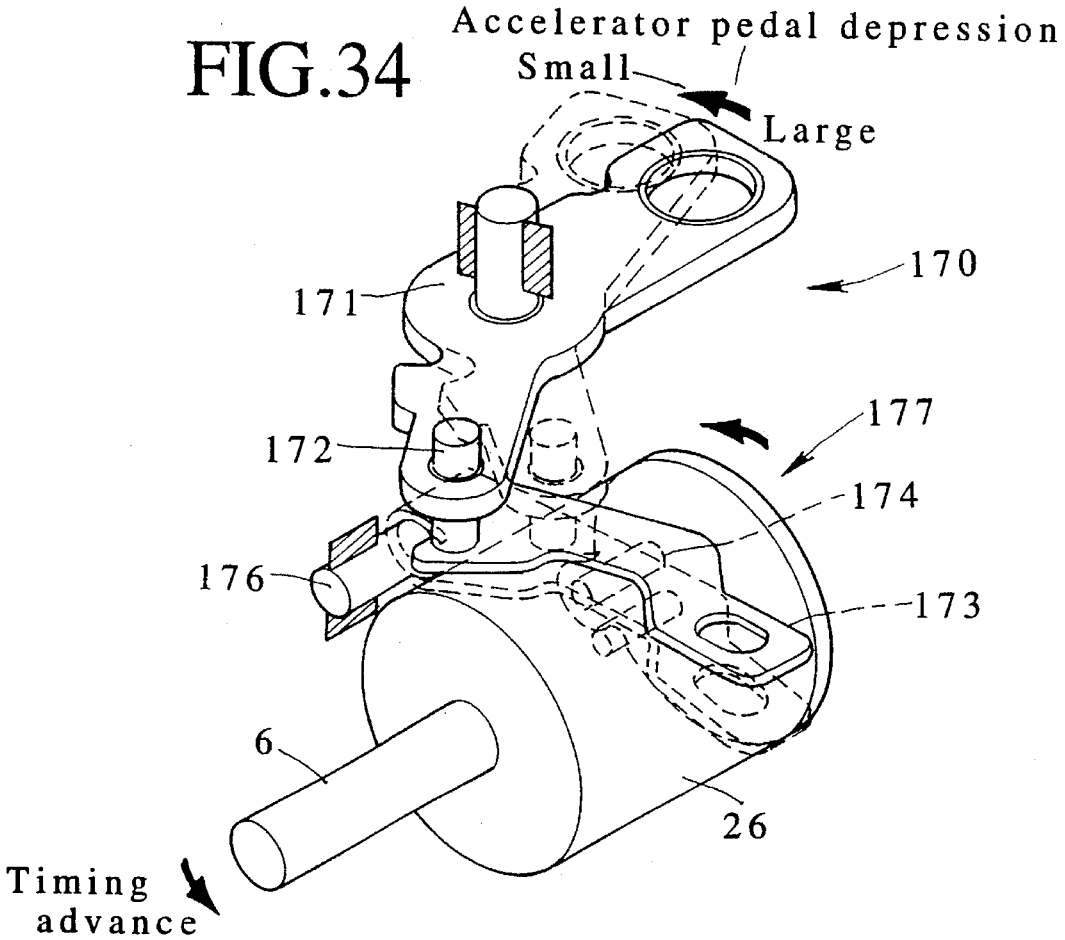
FIG. 34 is a perspective view of an essential portion of a prestroke controller 170 which is a twelfth embodiment of the invention (sixth aspect).
Figure 35:
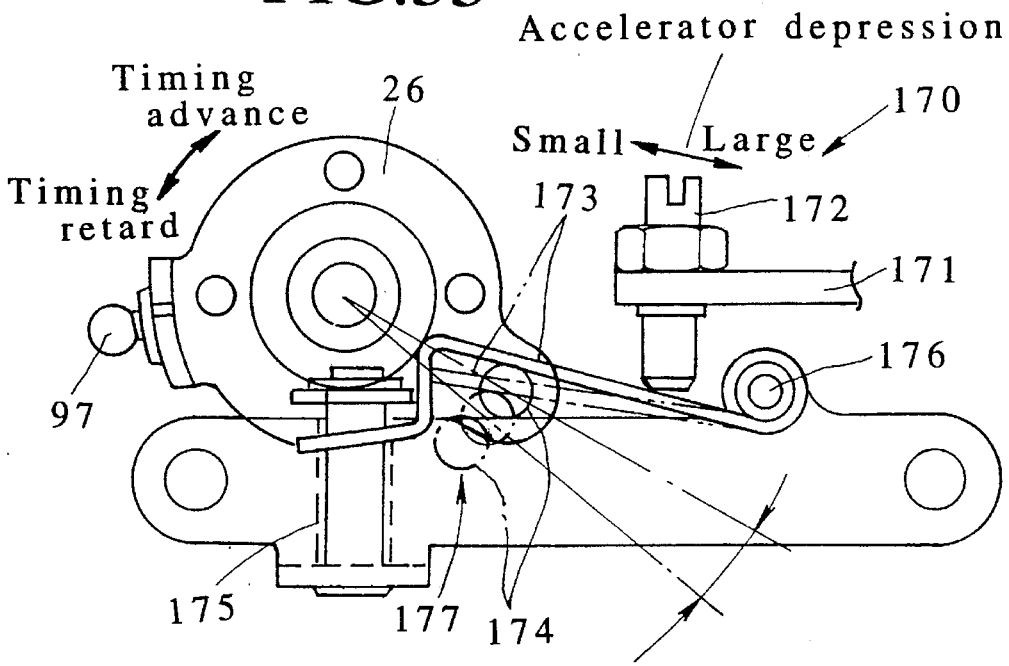
FIG. 35 is a side view of the essential portion of the prestroke controller 170 shown in FIG. 34.
Figure 36:
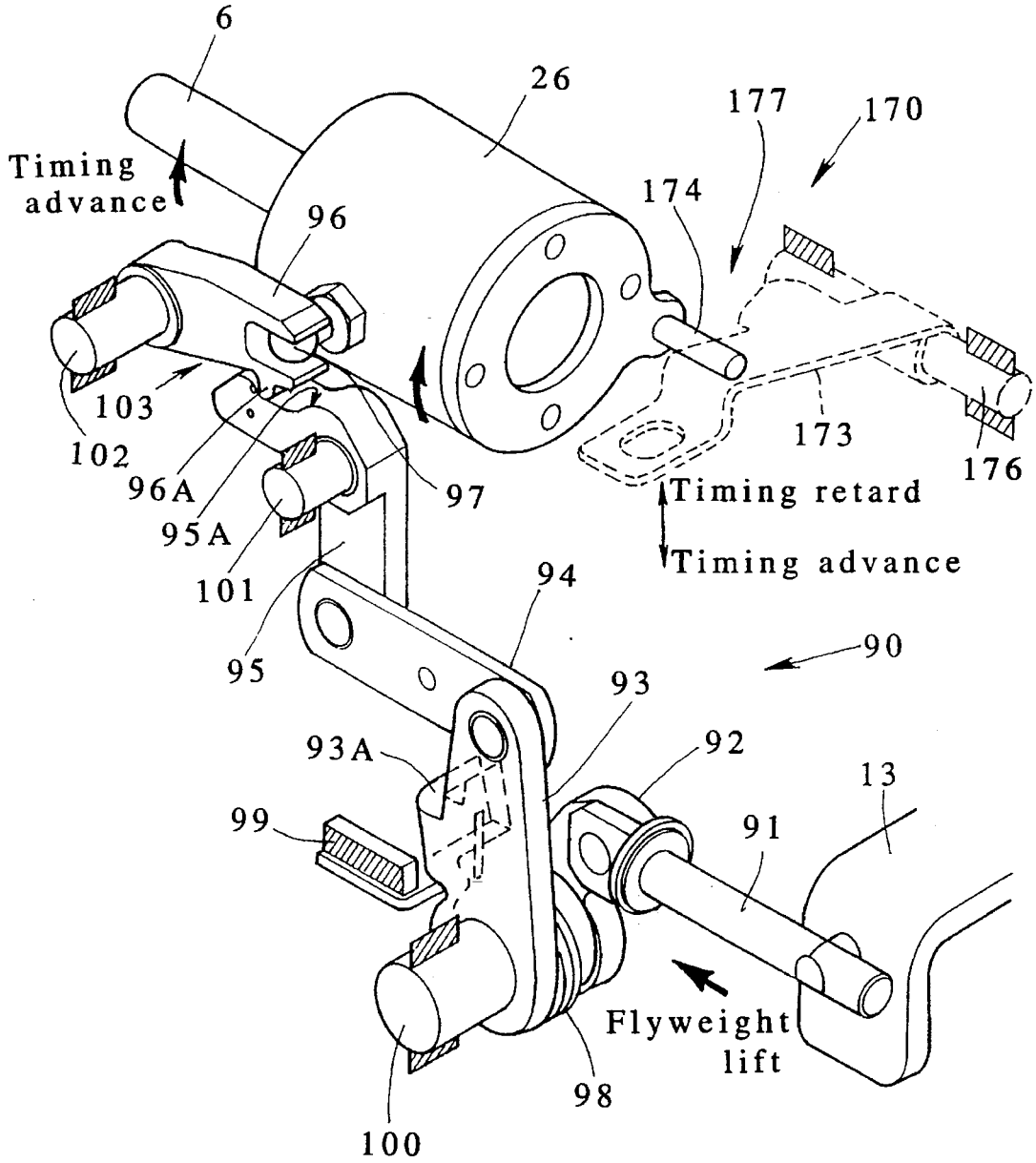
FIG. 36 is a perspective view of an essential portion of the prestroke controller 170 shown in FIG. 34 combined with the prestroke controller 90 (sixth embodiment shown in FIG. 21).

FIG. 34 is a perspective view of an essential portion of the prestroke controller 170, FIG. 35 is a side view of the same portion and FIG. 36 is a perspective view of the same portion combined with the prestroke controller 90 (FIG. 21). The prestroke controller 170 comprises a speed lever 171 which is rotated to an angle corresponding to the degree of depression of the accelerator pedal by the aforementioned accelerator wire 77 (see FIG. 10 relating to the first aspect of the invention), an adjustment screw 172 mounted on one end of the speed lever 171, an inclined lever 173 contactable with the lower tip of the adjustment screw 172, an abutment pin 174 fixed on the outer surface of the magnetic coupling 26 to be contactable with the inclined lever 173 from below, and a coil spring 175 for urging the inclined lever 173 upward.

When the speed lever 171 is rotated by the accelerator wire 77 to an angle corresponding to a certain degree of depression of the accelerator pedal, the adjustment screw 172 moves along the upper surface of the inclined lever 173, causing the inclined lever 173 to rotate about a pivot shaft 176 against the force of the coil spring 175. As a result, the abutment pin 174 of the magnetic coupling 26 is pushed downward, thereby rotating the magnetic coupling 26 by a given angle and thus advancing the injection timing.

In other words, the abutment pin 174 abutting on the abutment pin 174 constitutes an accelerator wire side torque transfer mechanism 177 between the side of the speed lever 171 and the magnetic coupling 26.

Figure 37:
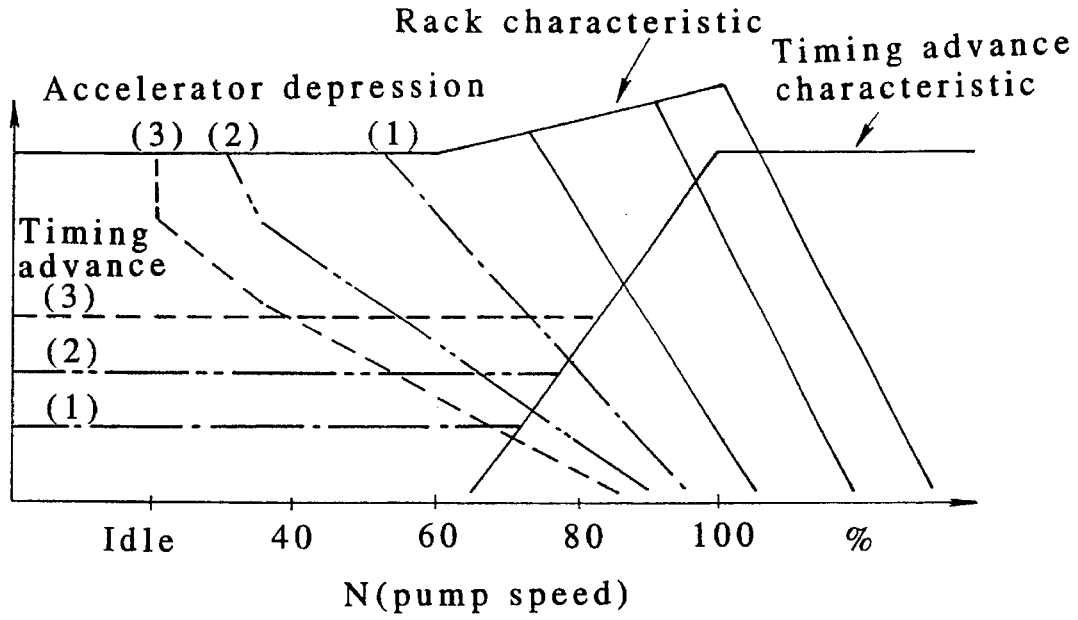
FIG. 37 is a graph relating to the prestroke controller 170 showing injection timing advance characteristic curves and governor characteristic curves as a function of pump speed.

Therefore, as shown in FIG. 37, the injection timing can be mechanically advanced or retarded in correspondence with the degree of accelerator pedal depression (advanced when the degree of accelerator pedal depression is small in this embodiment), independently of the lift of the flyweight 11 and of any electrical control such as based on oil or coolant temperature detection in low-temperature or low-load injection timing advance.

In FIG. 37, the accelerator pedal depression degrees (1), (2) and (3) correspond to advance amounts (1), (2) and (3). As can be seem, the amount of advance decreases with increasing accelerator pedal depression.

In addition, the prestroke control characteristic can be determined as desired by appropriately designing the sectional shape of the inclined lever 173 and can thereafter be adjusted from the outside by turning the adjustment screw 172.

The prestroke controller 170 according to this twelfth embodiment can be utilized as an auxiliary device which can be attached to or detached from the mechanical governor 2 as required.

Figure 38:
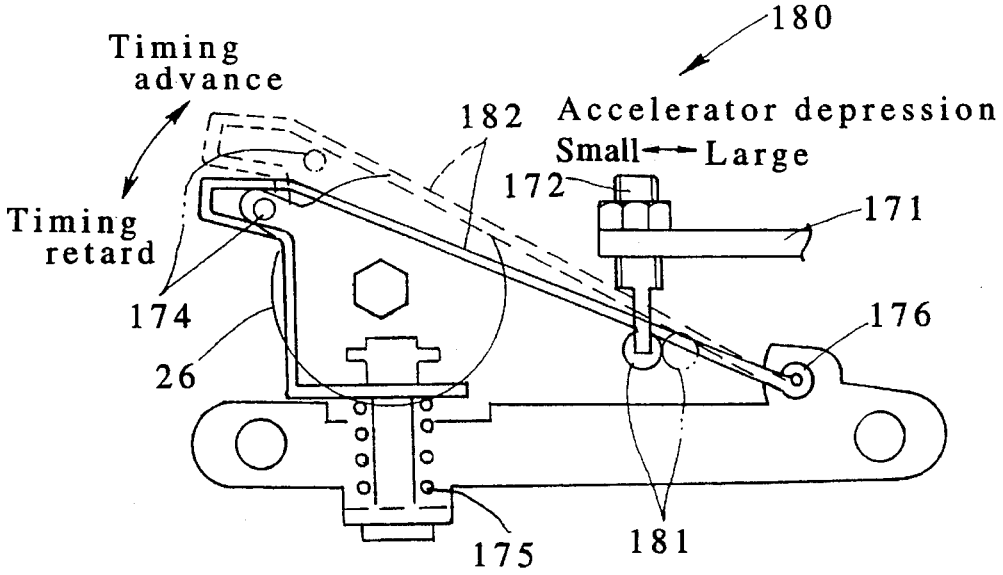
FIG. 38 is a side view of an essential portion of a prestroke controller 180 which is a thirteenth embodiment of the invention (sixth aspect).

The sixth aspect of the invention is not limited to this twelfth embodiment but can also be configured in other ways such as in the manner of the thirteenth embodiment shown in FIG. 38.

FIG. 38 is a side view of an essential portion of a prestroke controller 180 which is a thirteenth embodiment of the invention. The prestroke controller 180 alters the positional relationship among the abutment pin 174, the speed lever 171 and the adjustment screw 172 of the prestroke controller 170.

The prestroke controller 180 comprises the speed lever 171, the adjustment screw 172, a roller 181 fitted on the lower end of the adjustment screw 172, an inclined lever 182 corresponding to the inclined lever 173, the abutment pin 174 and the coil spring 175.

The vertical movement of the inclined lever 182 caused by rotation of the speed lever 171 rotates the magnetic coupling 26 via the abutment pin 174. Differently from the prestroke controller 170 according to the twelfth embodiment of FIG. 34, the injection timing is also advanced when the accelerator pedal depression is "large" (near full depression) when the roller 181 moves along the lower surface of the inclined lever 182 in the direction of the 174.

As explained in the foregoing, this invention makes it possible to utilize the advantages of a magnetic coupling in a prestroke controller for an engine fuel injection pump.

In accordance with the first aspect of the invention, the prestroke controller can be equipped with an add-on device for adjusting injection advance independently of flyweight lift and, as a result of the provision of the add-on device, there can be realized a greater degree of freedom in determining the injection timing advance characteristic, such as for injection timing advance in response to low temperature or low load (small degree of accelerator pedal depression).

In accordance with the second aspect of the invention, the provision of the limiting stop in association with the counterweight connected with the timing control rod enables restriction of the minimum prestroke (maximum injection timing advance), thereby making it possible to reliable secure the minimum prestroke unaffected by the temperature dependence of the driving side external magnet and the driven side internal magnet of the magnetic coupling.

In accordance with the third aspect of the invention, the adoption of a timing cam with a cam surface which restricts prestroke control characteristic ensures efficient and reliable transfer of flyweight lift to the side of the timing control rod.

In accordance with the fourth aspect of the invention, the provision of the prestroke control start time adjustment mechanism enables both adjustment of the prestroke control characteristic and matching adjustment.

In accordance with the fifth aspect of the invention, the provision of safety mechanism between the prestroke control mechanism (including the magnetic coupling) and the governor mechanism (including the members from the flyweight to the tension lever, etc.) ensures the ability of the tension lever and other members of the governor mechanism to move even if the magnetic coupling should stick, thereby ensuring operation of the governor mechanism for control of fuel injection quantity.

In accordance with the sixth aspect of the invention, the prestroke can be controlled independently of the flyweight lift since the timing control rod is driven in response to the degree of accelerator pedal depression.

What is claimed is:

1. A prestroke controller for an engine fuel injection pump comprising a plunger which sucks in and pressurizes fuel by reciprocating axially in response to rotation of a cam shaft connected with an engine, a control sleeve slidably fitted on the plunger, a timing control rod connected with the control sleeve and which operates to adjust the prestroke by changing the position of the control sleeve relative to the axial direction of the plunger, a flyweight which moves in response to rotation of the cam shaft, a magnetic coupling provided at a displacement transfer section between the flyweight and the timing control rod, a timing cam drivable in response to movement of the flyweight, a flyweight side torque transfer mechanism connecting the timing cam and the magnetic coupling, a tension lever connected to the flyweight for swinging the timing cam in response to movement of the flyweight, a connecting rod connected to the tension lever, a first lever connected to the connecting rod, a second lever which starts to rotate after being contacted by the first lever, a link connecting the second lever and the timing cam, and a spring which urges the second lever in a direction opposite from that in which torque can be transferred from the flyweight side torque transfer mechanism on the flyweight side through the timing cam to the magnetic coupling.

2. A prestroke controller for an engine fuel injection pump according to claim 1, wherein the flyweight side torque transfer mechanism includes a connecting pin provided on the outer surface of the magnetic coupling and a timing lever connected with the connecting pin and slidable in contact with a cam surface of the timing cam.

3. A prestroke controller for an engine fuel injection pump according to claim 2, wherein the connecting pin rotates in a plane perpendicular to an axis of rotation of the magnetic coupling.

4. A prestroke controller for an engine fuel injection pump according to claim 2, wherein the magnetic coupling is driven by converting movement of the timing cam into vertical movement of the timing lever.

5. A prestroke controller for an engine fuel injection pump according to claim 1, wherein a prestroke control characteristic is determined by selecting a profile of a cam surface of the timing cam.

6. A prestroke controller for an engine fuel injection pump according to claim 1, further comprising a spring which urges the second lever in a direction in which torque can be transferred from the flyweight side torque transfer mechanism on the flyweight side through the timing cam to the magnetic coupling.

7. A prestroke controller for an engine fuel injection pump comprising a plunger which sucks in and pressurizes fuel by reciprocating axially in response to rotation of a cam shaft connected with an engine, a control sleeve slidably fitted on the plunger, a timing control rod connected with the control sleeve and which operates to adjust the prestroke by changing the position of the control sleeve relative to the axial direction of the plunger, a flyweight which moves in response to rotation of the cam shaft, a magnetic coupling provided at a displacement transfer section between the flyweight and the timing control rod, a timing cam drivable in response to movement of the flyweight, a flyweight side torque transfer mechanism connecting the timing cam and the magnetic coupling;

a tension lever connected to the flyweight for swinging the timing cam in response to movement of the flyweight, a connecting rod connected to the tension lever, a first lever connected to the connecting rod, a second lever which starts to rotate after being contacted by the first lever, the second lever is formed with an initial position limiting projection and a final position limiting projection, and a link connecting the second lever and the timing cam.

8. A prestroke controller for an engine fuel injection pump according to claim 1, wherein the rotation radius R of the magnetic coupling is made large.

9. A prestroke controller for an engine fuel injection pump comprising a plunger which sucks in and pressurizes fuel by reciprocating axially in response to rotation of a cam shaft connected with an engine, a control sleeve slidably fitted on the plunger, a timing control rod connected with the control sleeve and which operates to adjust the prestroke by changing the position of the control sleeve relative to the axial direction of the plunger, a flyweight which moves in response to rotation of the cam shaft, a magnetic coupling provided at a displacement transfer section between the flyweight and the timing control rod, a timing cam drivable in response to movement of the flyweight, a flyweight side torque transfer mechanism connecting the timing cam and the magnetic coupling, the timing cam is formed with a right angle bend to have an arm of length L1 on the side of the flyweight and arm of length L2 on the side of the magnetic coupling, L1 being greater than L2.

10. A prestroke controller for an engine fuel injection pump comprising a plunger which sucks in and pressurizes fuel by reciprocating axially in response to rotation of a cam shaft connected with an engine, a control sleeve slidably fitted on the plunger, a timing control rod connected with the control sleeve and which operates to adjust the prestroke by changing the position of the control sleeve relative to the axial direction of the plunger, a flyweight which moves in response to rotation of the cam shaft, a magnetic coupling provided at a displacement transfer section between the flyweight and the timing control rod, a prestroke control start time control mechanism provided between the magnetic coupling and the flyweight for adjusting the prestroke control start time in accordance with movement of the flyweight, the prestroke control start time adjustment mechanism includes a tension lever connected to the flyweight, a fixed block fixed to the tension lever, a phase adjustment rod passing through the fixed block, an adjustment cap nut engaged with the phase adjustment rod and abutting on the fixed block, and a fastening bolt engaged with the adjustment cap nut on the opposite side thereof from the phase adjustment rod.

11. A prestroke controller for an engine fuel injection pump according to claim 10, wherein the prestroke control start time adjustment mechanism includes the phase adjustment rod connected with the flyweight to be adjustable in amount of projection, a first lever connected with the phase adjustment rod, and a second lever drivable via the first lever at prescribed timing and by an amount proportional to flyweight lift.

12. A prestroke controller for an engine fuel injection pump according to claim 10, wherein the adjustment cap nut and the fastening bolt can be operated from the exterior.

13. A prestroke controller for an engine fuel injection pump comprising a plunger which sucks in and pressurizes fuel by reciprocating axially in response to rotation of a cam shaft connected with an engine, a control sleeve slidably fitted on the plunger, a timing control rod connected with the control sleeve and which operates to adjust the prestroke by changing the position of the control sleeve relative to the axial direction of the plunger, a flyweight which moves in response to rotation of the cam shaft, a magnetic coupling provided at a displacement transfer section between the flyweight and the timing control rod, a prestroke control mechanism including the magnetic coupling, and a safety mechanism provided between a prestroke control mechanism including the magnetic coupling and a governor mechanism including the flyweight for ensuring operation of the governor mechanism based on the movement of the flyweight even when a problem arises in the magnetic coupling, the safety mechanism being provided between a tension lever linked with the flyweight in the governor mechanism and a lever connected to a phase adjustment rod movable with respect to the tension lever.

14. A prestroke controller for an engine fuel injection pump according to claim 13, wherein the safety mechanism includes a fixed block fixed to the tension lever and a spring provided between the phase adjustment rod and the first lever, the phase adjustment rod being movable against the force of the spring.

15. A prestroke controller for an engine fuel injection pump comprising a plunger which sucks in and pressurizes fuel by reciprocating axially in response to rotation of a cam shaft connected with an engine, a control sleeve slidably fitted on the plunger, a timing control rod connected with the control sleeve and which operates to adjust the prestroke by changing the position of the control sleeve relative to the axial direction of the plunger, a speed lever connected to an accelerator wire of the engine, a magnetic coupling provided at a displacement transfer section between the speed lever and the timing control rod, an inclined lever drivable by the speed lever, and an accelerator wire side torque transfer mechanism connecting the inclined lever and the magnetic coupling;

the accelerator wire side torque transfer mechanism includes an abutment pin provided on the outer surface of the magnetic coupling to be drivable by the inclined lever.

16. A prestroke controller for an engine fuel injection pump comprising a plunger which sucks in and pressurizes fuel by reciprocating axially in response to rotation of a cam shaft connected with an engine, a control sleeve slidably fitted on the plunger, a timing control rod connected with the control sleeve and which operates to adjust the prestroke by changing the position of the control sleeve relative to the axial direction of the plunger, a speed lever connected to an accelerator wire of the engine, a magnetic coupling provided at a displacement transfer section between the speed lever and the timing control rod, an inclined lever drivable by the speed lever, and an accelerator wire side torque transfer mechanism connecting the inclined lever and the magnetic coupling, an adjustment screw mounted on the speed lever to be contactable with the inclined lever, and a coil spring for urging the inclined lever in a injection timing retard direction.

17. A prestroke controller for an engine fuel injection pump according to claim 16, wherein the adjustment screw can be adjusted from the outside.

18. A prestroke controller for an engine fuel injection pump according to claim 16, wherein the adjustment screw abuts on an upper surface of the inclined lever.

19. A prestroke controller for an engine fuel injection pump according to claim 16, wherein a roller is fitted on a lower end of the adjustment screw to contact a lower surface of the inclined lever.

20. A prestroke controller for an engine fuel injection pump comprising a plunger which sucks in and pressurizes fuel by reciprocating axially in response to rotation of a cam shaft connected with an engine, a control sleeve slidably fitted on the plunger, a timing control rod connected with the control sleeve and which operates to adjust the prestroke by changing the position of the control sleeve relative to the axial direction of the plunger, a speed lever connected to an accelerator wire of the engine, a magnetic coupling provided at a displacement transfer section between the speed lever and the timing control rod, an inclined lever drivable by the speed lever, an accelerator wire side torque transfer mechanism connecting the inclined lever and the magnetic coupling, wherein a prestroke control characteristic is determined by selecting a sectional shape of the inclined lever.

* * * * *